United States Patent [19]

McGinley

[11] 4,122,871

[45] Oct. 31, 1978

[54] METHOD OF WEAVING AND APPARATUS THEREFOR

[76] Inventor: Thomas F. McGinley, 175 Prospect St., Phillipsburg, N.J. 08865

[21] Appl. No.: 703,307

[22] Filed: Jul. 7, 1976

[51] Int. Cl.[2] ..... D03D 47/00

[52] U.S. Cl. ..... 139/11; 139/429

[58] Field of Search ..... 139/11, 20, 28, 48, 139/429, 436, 443, 444, 445, 188

[56] References Cited

U.S. PATENT DOCUMENTS

| | | | |
|---|---|---|---|
| 733,333 | 7/1903 | Powell | 139/445 |
| 2,392,489 | 1/1946 | Martin | 139/28 |
| 2,893,440 | 7/1959 | Brusadelli | 139/28 |
| 2,948,302 | 8/1960 | Bejeuhr | 139/28 |
| 3,310,071 | 3/1967 | Mauri | 139/444 |
| 3,848,642 | 11/1974 | Steiner | 139/48 |

FOREIGN PATENT DOCUMENTS

| | | | |
|---|---|---|---|
| 432,097 | 7/1926 | Fed. Rep. of Germany | 139/11 |
| 277,634 | 1970 | U.S.S.R. | 139/11 |

*Primary Examiner*—Henry S. Jaudon

*Attorney, Agent, or Firm*—Lerner, David, Littenberg & Samuel

[57] ABSTRACT

A method of weaving and apparatus therefor wherein a plurality of successive sheds are formed and retained to establish waves of sheds which travel longitudinally of the warp threads or "warp waves" as distinguished from the method using "weft waves" which travel transversely of the warp threads. The method and apparatus utilize conventional harness mechanisms or the like to produce the warp sheds but specially adapted weft-thread-inserting devices. The sheds are releasably retained by shed-retaining members which act independently of the shed-producing means. Each shed travels in a substantially straight line or plane from the shed-producing means to a location adjacent the fell of the cloth where the shed-retaining means release the shed. In addition to the shed-retaining means, each traveling shed can be provided with guide means for the weft-thread-inserting means. The shed-retaining members and guide means travel in a closed loop for repetitive operation. Beat-up means are provided which are capable of beating-up the weft thread simultaneously all across the fell of the cloth. The beat-up means may travel in a closed loop with the shed-retaining members and the guide means or non-traveling beat-up means may be provided.

82 Claims, 52 Drawing Figures

METHOD OF WEAVING AND APPARATUS THEREFOR

SUMMARY OF THE INVENTION

This invention relates to a method of and apparatus for weaving and more particularly, to such a method and apparatus wherein any reasonable desired number of successive sheds may travel simultaneously in the longitudinal direction of the warp threads In the development of weaving looms a limiting factor on their rates of production has been the speed with which a thread of weft or filling can be carried across the full width of the loom. Normally, the weft thread is inserted into the open end of a shed formed by a selective separation of warp threads as determinded by the desired pattern and carried or sent through the shed and out the other side. All such looms require the complete insertion of one weft thread through a single open shed followed by the beat up of the weft thread into the fell of the cloth and a change in the warp shed before insertion of the next weft thread can begin.

The aforementioned method of weaving by sequential weft thread insertion results in a steadily reduced operating speed as the width of the loom increases. The latter necessarily results in an increased travel distance for the means of weft thread insertion. Furthermore, the severe reduction in operating speed is present regardless of whether the weft inserting means is a shuttle, a gripper-missile, a water jet, a rapier, or other means.

In addition, since the sequential steps of weft-laying, beat-up and shed changing occur in the same physical space each step must follow the other in time sequence, causing the weft-laying means to be active only approximately one-half the time and to remain motionless and unproductive one-half the time. This puts a premium on the operating speed of the weft-laying means and results in designs requiring excess power and causing excess wear and noise.

Still another disadvantage of the previously described method of weaving is that the shed-forming mechanism is forced to dwell at the open shed position for a sufficient interval to allow the weft-laying or inserting mechanism to traverse the open shed after which it must be activated to form the succeeding open shed at very high speed, thus subjecting both the shed-forming mechanism and the warp threads to high acceleration stresses. Similarly, the high operating speeds of the weft-laying means employed frequently cause such high stresses to be exerted on the weft threads that the strength of the threads may, in fact, become a limiting factor on the speeds that may be utilized.

Recent efforts have been made in the development of what is referred to as the "multi-phase" or "multi-shed" method of weaving. This method uses multiple sheds traveling in a wave-like form transversely across the loom from one edge of the fabric to the other. Each of the waves constitutes a separate and distinct shed within which a small shuttle travels carrying a length of weft yarn or thread equal to the width of the fabric.

While the so-called multi-phase or multi-shed weaving reduces the mentioned disadvantages of looms in general use, it has disadvantages of its own which are inherent to the transverse multi-phase method of weaving. In particular, each shuttle must be wound with a discrete measure of weft yarn equal to the width of the fabric before each pick begins. This winding requires complicated and costly mechanisms.

Another disadvantage of the multi-phase weaving is the difficulty in obtaining a uniform and form beat up of the weft yarn into the fell of the cloth because of the necessity of pressing the weft yarn into the woven cloth progressively across the fabric behind each shuttle as it travels across the loom.

Still another disadvantage of multi-phase weaving is the severe limitation in the diversity of weaves available on the multi-phase loom because of the nature of the mechanisms required to form the wave-like undulating sheds traveling transversely across the loom.

A further disadvantage of multi-phase weaving is the difficulty in repairing or replacing a broken or missing weft thread in the fabric, since the open shed in which a weft thread is laid is only slightly larger than the small shuttle which supplies the thread because another weft thread is quickly pressed against it in that a weft thread is supplied by a shuttle immediately behind the first shuttle.

Also known are looms of a type as described in U.S. Pat. No. 2,742,058 to Gentilini wherein sheds are formed on a series of parallel plates rotating around a common axis extending in a direction normal or transverse to the direction of the warp threads. These looms, sometimes known as "rectilinear" looms, cause the warp threads to engage and conform to a portion of the polygonal periphery of said parallel plates. The rotation of these plates forms warp sheds which follow a curved path along that portion of the periphery of the plates which is contacted by the warp threads. A plurality of warp sheds moving longitudinally to the warp threads is thus formed, thereby affording simultaneously more than one shed for weft insertion. However, a separate rotating plate must be afforded for each warp thread. This severly limits the number of warp threads per inch which can be woven.

Another disadvantage of the "rectilinear" type loom is the difficulty in making changes in the weaving pattern. For pattern changes or for changes in warp thread density per inch, the rotating plates must be completely disassembled and reassembled, making such changes costly and time-consuming.

Also, due to the limited space available and the curved path of the sheds, ordinary means of weft insertion such as conventional shuttles or gripper-shuttles are replaced by needles or thin rods to insert the weft. Since these needles must be retracted from the shed after inserting the weft thread, one-half the operational time of the open shed is needed for the non-productive retraction of the needle.

Another disadvantage of the rectilinear loom is the considerable reduction in production rate as the width of the loom is increased. Each increment of width must be traversed by the weft-inserting needle both when it is inserted and when it is retracted.

Yet another disadvantage of the rectilinear loom is the difficulty in releasing the warp and weft threads from the "drum" of rotating plates and obtaining a firm beat-up for closely spacing the weft threads in the fabric.

A variation of the rectilinear loom as shown in U.S. Pat. No. 3,310,071 to Mauri utilizes conventional shed-forming means to achieve multi-weave versatility. However, this loom does not afford multi-sheds simultaneously for weft insertion. Only one needle is in motion in a shed at any given instant. Also, this loom does not afford ay means to retain the open shed other than the weft-inserting needle itself which, as it retracts, progressively allows the shed to close upon the weft thread, thereby causing the timing of the beat-up, in relation to the shed-closing, to be progressively different from one side of the fabric to the other.

In accordance with the present invention, the foregoing shortcomings and disadvantages are effectively overcome. In particular, the production-limiting factor of only a single weft thread being laid at any one time is eliminated in that in accordance with the method and apparatus of the present invention the laying of multiple weft threads simultaneously is accomplished in sheds formed with conventional shed-forming equipment. Moreover, the present invention eliminates the need to reduce operating speeds as the width of the woven product increases. At the same time, it is not necessary to operate the weft-laying mechanism at speeds which cause severe stress both to parts of the loom and weft threads in that more moderate speeds may be used. For example, in a loom operating in accordance with this novel method of weaving the continuous availability of even one shed for weft-insertion would allow the weft-laying means to operate at one-half the weft-inserting speed utilized in a conventional loom and yet equal the rate of weft-thread production attained in said conventional loom. This is due to the inactivity of weft-laying means in conventional looms for approximately one-half the time.

The present invention eliminates the need for the shed-forming mechanism to stop and remain at the open-shed position while the shuttle or other means traverses the full width of the shed. Instead, the shed-forming mechanism may start the formation of a succeeding shed almost immediately after forming the preceding shed thereby affording much slower up and down motion of the warp threads for any corresponding production speeds.

The further advantages of the present invention over one or more of the above described methods of weaving include elimination of the necessity of winding individual shuttles with a short length of weft yarn. Instead, there is provided a method whereby ordinary shuttles, gripper shuttles, or other means may be utilized to insert weft yarn.

A further advantage of the present invention is the elimination of the difficulty in obtaining a uniform and solid beat up by enabling the weft yarn to be beat up simultaneously across the entire width of the fell of the cloth.

Another advantage of the present invention is the elimination of restrictions on the diversity of weave patterns by preserving the use of present shed-forming means such as cam-operated harness, dobby head mechanisms and Jacquard shedding mechanisms.

Still another advantage of the present invention is the achievement of all of the above improvements and still afford means for repairing or replacing a broken or missing weft thread.

The above listed advantages and improvements of the present invention are achieved with but slight enlargement of present weaving looms. Since the left-off mechanism, the shedding mechanism and the take-up mechanism are not altered, and since only the picking and beating-up mechanism are changed along with only a slightly enlarged space between the shedding mechanism and the fell of the cloth, this new method of weaving may be installed as a modificaton to many looms presently in use.

The inherent advantage and improvements of the present invention will become more readily apparent upon considering the following detailed description of the invention and by reference to the drawings in which:

FIGS. 1*a* through 1*d* illustrate schematically, as viewed in side elevation, successive steps of a method of weaving in accordance with the present invention;

FIGS. 26*a*–31*a* are schematic plan views illustrating the handling of weft threads at incrementally different positions in accordance with the present invention;

FIGS. 26*b*–31*b* are schematic elevational views illustrating the positions of the shuttle boxes for the incremental positions of FIGS. 26*a*–31*a;*

FIGS. 26c–31c are schematic elevational views of the shed-retaining means for the respective incremental positions of FIGS. 26a–31a; and FIGS. 26d–31d are schematic elevational views illustrating the handling of the weft threads on one side of the loom for the respective incremental positions of FIGS. 26a–31a.

Referring now more particularly to FIGS. 1a through 1d of the drawings, there is illustrated schematically four progressive steps in the weaving of cloth or the like in accordance with the present invention. The letters "x" and "y" designate schematically conventional shed-forming means which changes the position of warp threads such as 16 and 18 in accordance with a preselected pattern. The warp sheds progress generally from left to right in each of the figures as indicated by the arrow at 20 in a manner to be described more fully hereinafter. The fell of the cloth is indicated generally at F and the successive weft threads are designated w, w1, w2, w3, w4, etc. Releasable shed-retaining stations, hereinafter called retaining stations are designated 22, 24 and 26 in FIG. 1a. After the sheds are formed in conventional manner, the releasable shed-retaining means, hereinafter called retainers, are inserted therein so as to maintain the sheds open as illustrated at retaining stations 22 and 24 as they progress in a substantially straight line or plane to the fell of the cloth F.

Figure 1A:
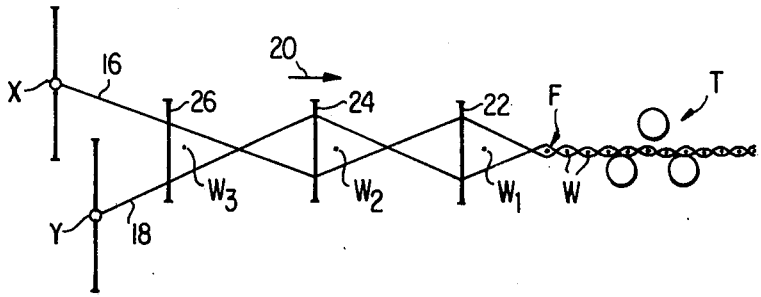
Figure 1B:
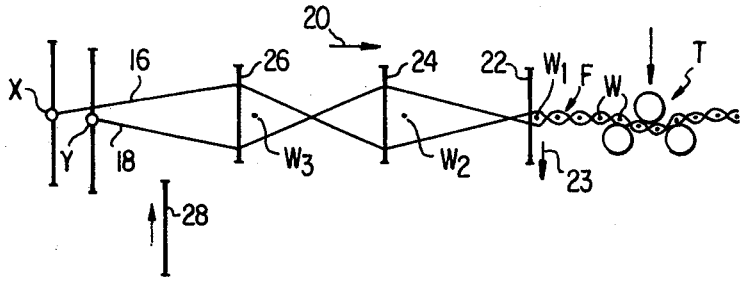

In FIG. 1b, the shed has been released at retaining station 22 and the beat up of the weft thread immediately to the right of the retaining station 22 is accomplished as the shed-retaining station 22 begins to move in the direction indicated by arrow 23. Meanwhile, a new retaining station is about to be inserted adjacent the shed-forming means as indicated by the arrow 29 in FIG. 1b.

Figure 1C:
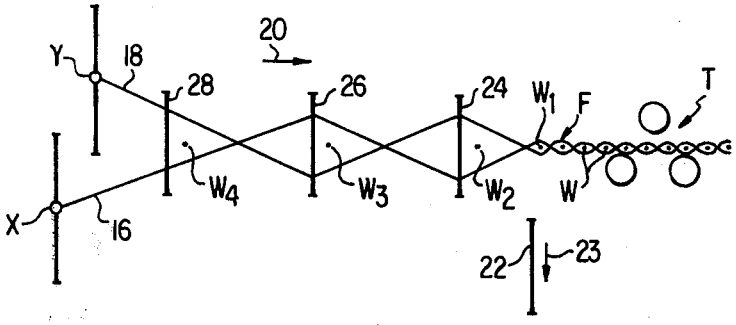

In the FIG. 1c position, the retaining station 22 has moved completely out of contact with its associated weft thread and the retaining station 28 has moved into position to maintain a newly created shed in its open position.

Figure 1D:
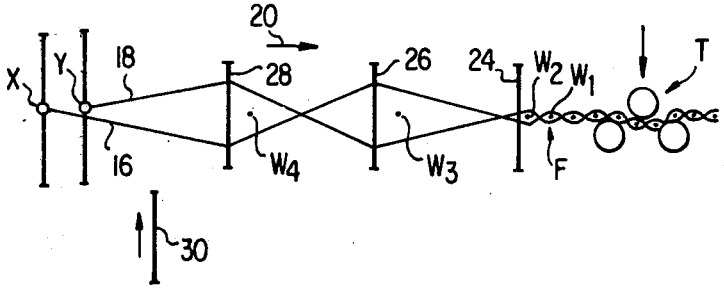

In FIG. 1d, retaining station 24 has released its shed and is about ready to begin the beat up of the weft thread immediately to the right thereof into the fell of the cloth while a new retaining station 30 is about to be inserted between adjacent warp threads and traveling in the direction indicated by arrow 29.

In each of FIGS. 1a–1d, it is desirable to employ a suitable tensioning means, such as indicated generally at T, comprising a series of rollers which engage the woven fabric and which are moved in timed sequence with the release of the shed to compensate for tension variations caused by the release of a shed between the warp threads and the fell of the cloth F.

Figure 4:
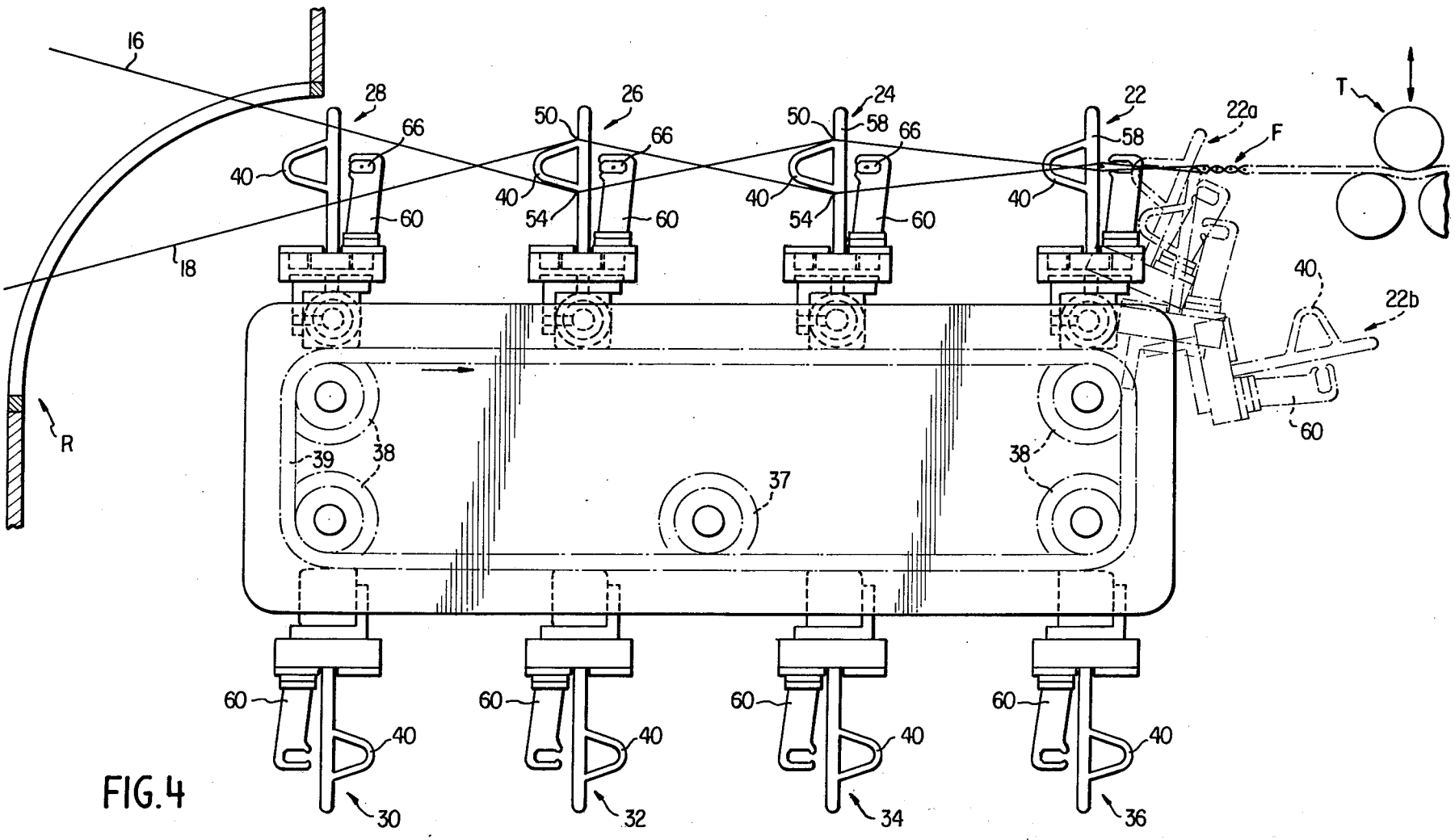
FIG. 4 is a side elevational view, with parts broken away, of the apparatus shown in FIGS. 2 and 3.

Reference is made to FIG. 4 for a showing of the actual apparatus existing in one embodiment of the invention at retaining stations indicated generally at 22, 24, 26, 28, 30, 32, 34 and 36. As illustrated in FIG. 4, sprockets 38 are driven by any suitable means, not shown, to drive a chain conveyor 39 in a clockwise direction as viewed in FIG. 4 with an idler chain take-up roll being indicated at 37. A reed R is stationarily mounted by any suitable means between the harness mechanism or other shed forming means and conveyor 39 to effect preliminary lateral spacing of warp threads such as are shown at 16 and 18.

Figure 5:
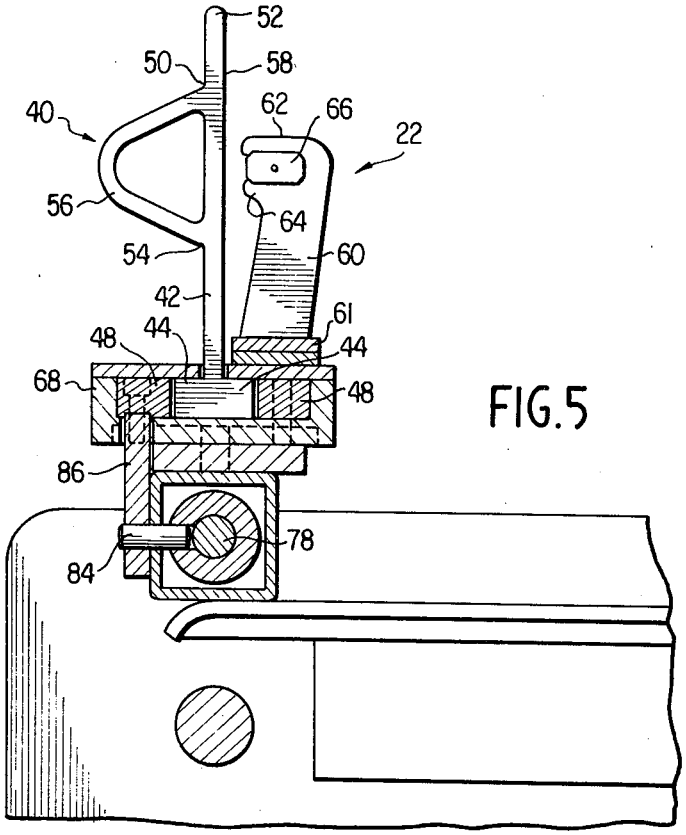
FIG. 5 is a fragmentary elevational view taken in vertical cross section along line 5—5 of FIG. 2 and drawn to an enlarged scale.

One of the elements at each of the releasable shed-retaining stations is a combined shed-retainer and reed member indicated generally at 40 in FIG. 5. Retainer 40 in one of its two operating positions is across the warp threads and thus retains the warp thread in vertically spaced-apart position, thereby maintaining the shed. Each combination shed-holder and read 40, is shown in FIG. 5 to comprise a support rod 42 having laterally extending flanges 44 which extend into slots as seen best in FIG. 6 at 46 in reciprocating rack members 48.

Figure 6:
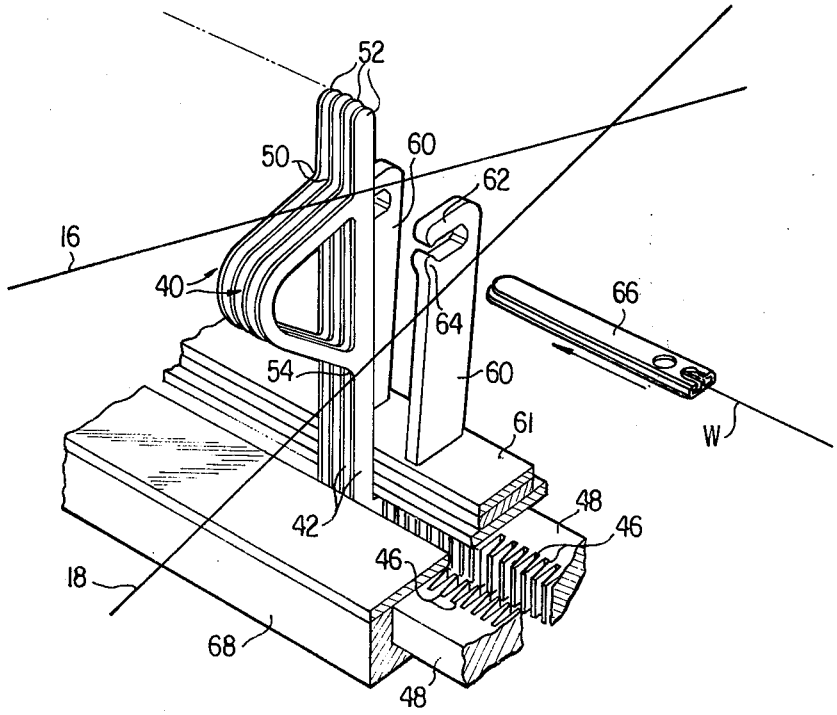
FIG. 6 is a fragmentary perspective view illustrating one general arrangement of shed-retaining means and shuttle support means in accordance with the present invention.

The retainer reed 40 has an upper surface 50 for engaging a warp thread or threads when retainer 40 is rotated to its hold position. Retainer 40 has a portion 52 which extends any desired length above the warp-engaging surface 50 as is best shown in FIG. 6. The retainer 40 when rotated to its hold position also has a lower warp thread-engaging surface 54 as is clearly seen in FIGS. 5 and 6 with warp thread 18 shown in FIG. 6. A loop extends between the warp-engaging surfaces. A front surface 58 of retainer 40 serves to beat up the weft thread after it has been inserted completely through the shed.

Mounted for travel with the retainers 40 are a plurality of shuttle guide members 60 mounted on a suppport frame means 61. Each guide member 60 has an upper jaw member 62 and a lower jaw member 64 vertically spaced so as to receive therebetween and to guide a traversing shuttle 66 which inserts a weft thread W as indicated schematically in the showing of FIG. 6.

Figure 2:
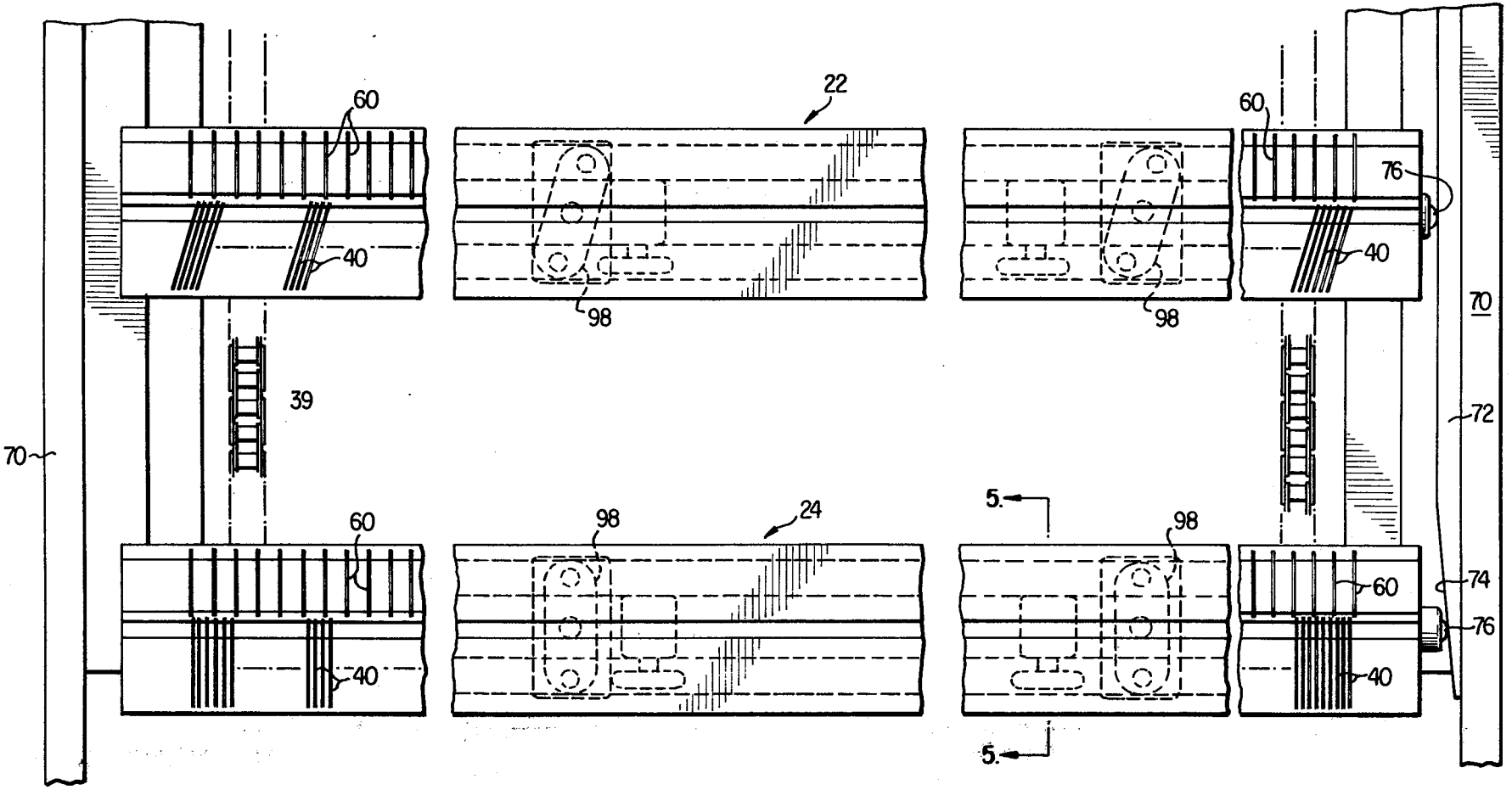
FIG. 2 is a fragmentary top plan view, with portions deleted, of an apparatus for weaving in accordance with the present invention.
Figure 3:
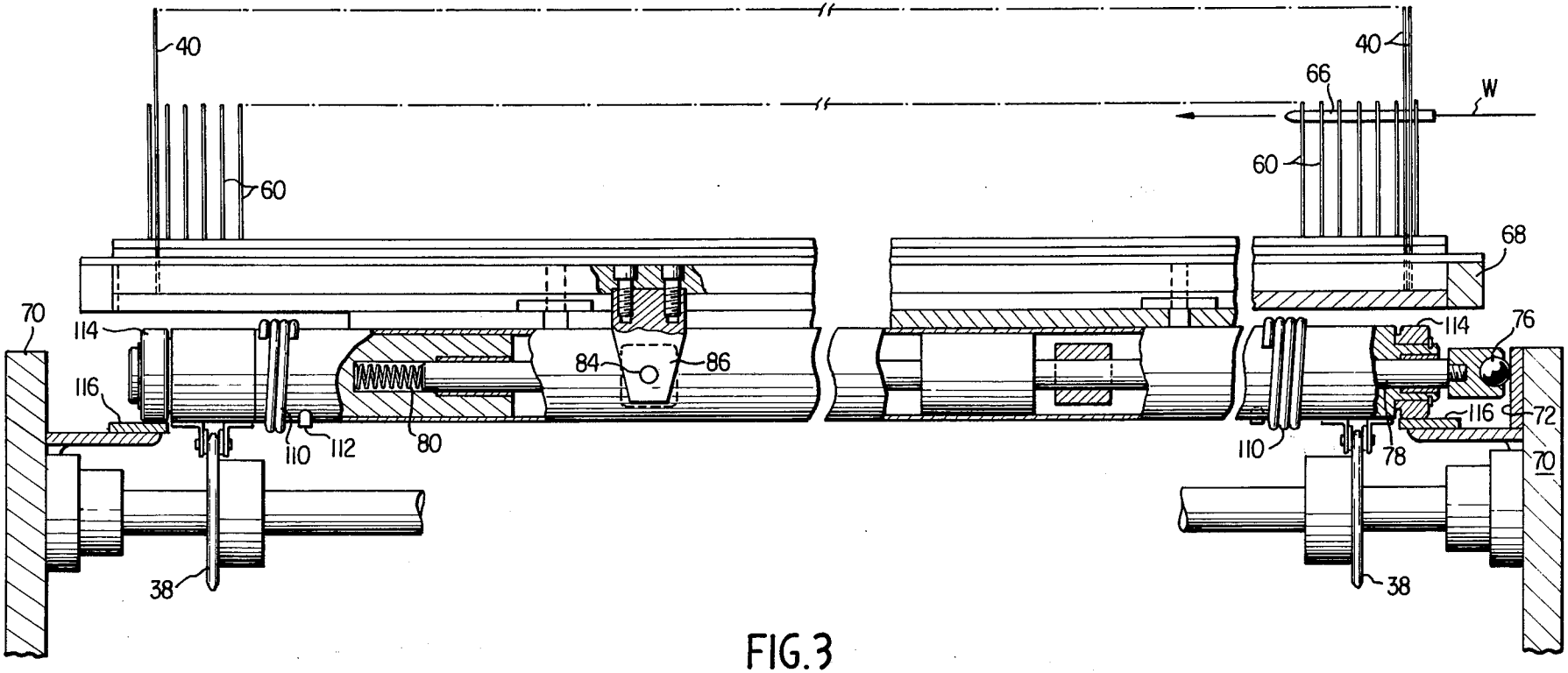
FIG. 3 is an elevational view, partially in vertical cross section and with parts broken away, of the apparatus shown in FIG. 2.
Figure 8:
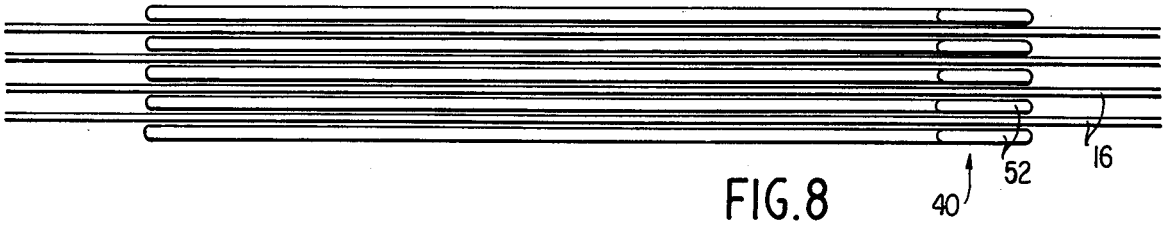
FIG. 8 is a top plan view illustrating the insertion of shed-retaining means between adjacent warp threads.
Figure 9:
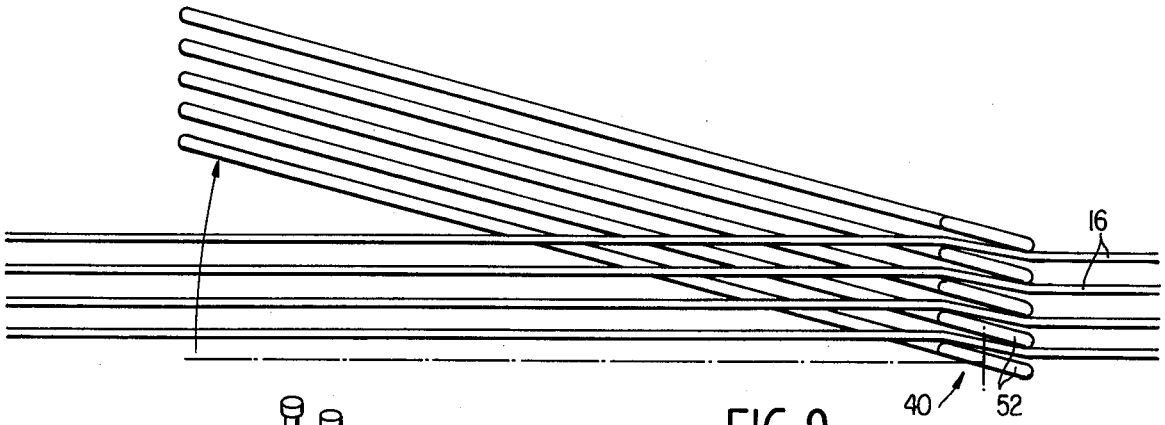
FIG. 9 is a top plan view similar to FIG. 8 but showing the shed-retaining means in their shed-retaining position.
Figure 7:
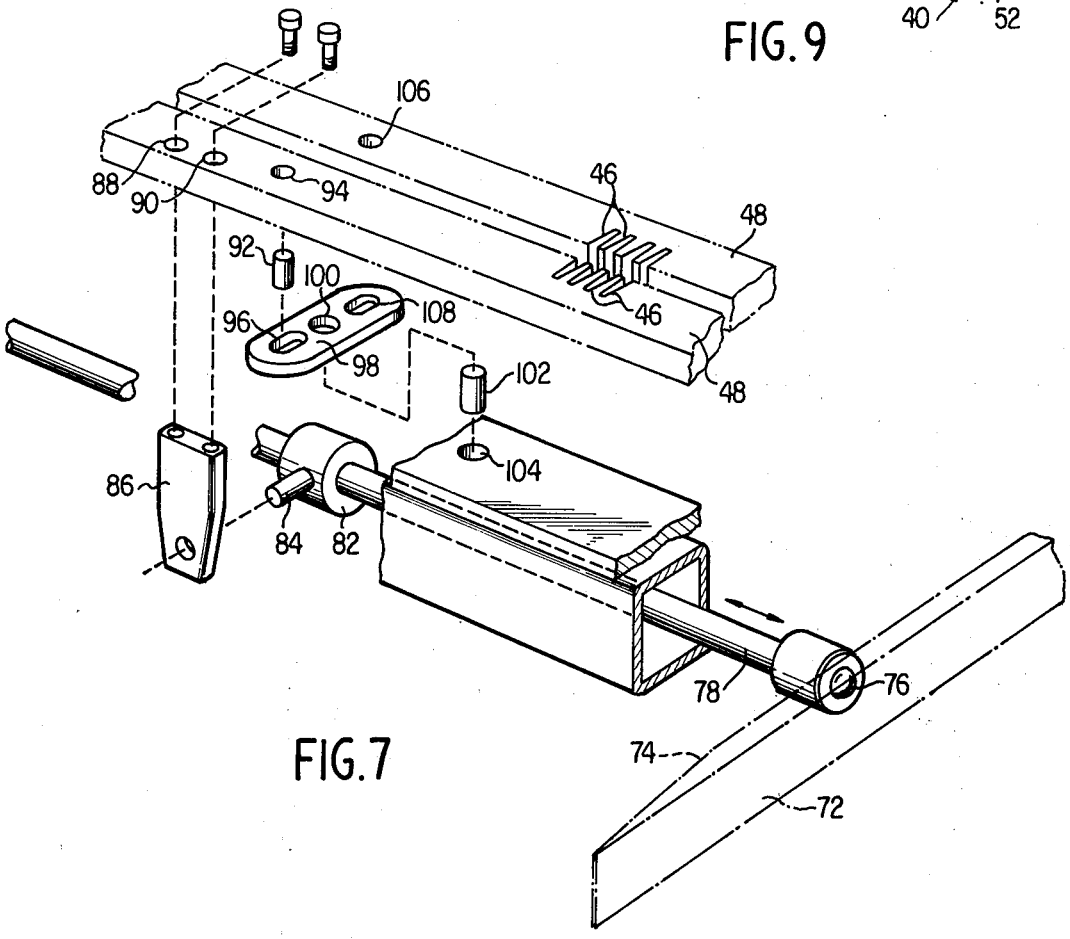
FIG. 7 is an exploded perspective view illustrating one form of a mechanism for operating the shed-retaning means.

Reference is now made to FIGS. 2, 3 and 7 for an illustration of one means for effecting operation of the retainers. In FIGS. 2 and 3, a main frame for the loom is shown at 70 having secured thereto a stationary cam member 72 with a rising surface thereon, 74. A cam follower 76 is shown in each of FIGS. 2, 3 and 7 in engagement with the stationary cam 72. As seen best in FIG. 3, the cam follower 76 is mounted on the extreme end of shaft 78 which is spring urged by means of compression spring 80 in FIG. 3 into engagement with the stationary cam 72. Shaft 78 also carries a hub 82, FIG. 7, which is provided with an offset rod 84 received in a force-transmitting lug 86 which is threadedly secured by bolt means in apertures 88 and 90 to one of the rack members 48. The same rack member 48 has a pin 92 received both in aperture 94 and in a slotted hole 96 of an operating lever 98 which has a central pivot at 100. A pin 102 is received jointly in central pivot 100 and in aperture 104 secured to the frame. The second rack member 48 has an aperture 106 corresponding to 94 and a pin, not shown, corresponding to 92 which extends between aperture 106 in the other rack 48 and aperture 108 in the operating lever 98. The aperture 108 is a slotted hole corresponding to a similar slotted hole 96 in the operating lever 98. Therefore, as cam follower 76 engages the stationary cam 72, reciprocatory motion is imparted to shaft 78, as indicated by the arrow in FIG. 7 One rack member 48 moves in one direction and the other rack member 48 moves in the opposite direction through the intermediary of the force-transmitting members which includes the operating lever 98. By this means the operating lever 98 moves from the one position shown in dotted lines in FIG. 2 associated with releasable retaining station 24 to the canted position of the operating lever 98 associated with the releasable retaining station 22 in FIG. 2. The retainers are substantially parallel to the warp threads to a position where the retainers 40 form an angle of about 15° with respect to the warp threads. Any desired angle may be used so long as the warp sheds are held open. These respective positions of the retaners 40 are shown in an enlarged scale in FIGS. 8 and 9. In the position in FIG. 9 the retainers are in a shed-retaining position and in the position shown in FIG. 8 the retainers are in a shed-releasing position. Therefore, it becomes a relatively easy matter to retain or release the sheds as is necessary for the formation of the woven product. For example, a falling cam surface (not shown) on cam 72, which results in a reversal of the motion imparted by rising surface 74, restores the retainers 40 to their initial position as shown in FIG. 8, thereby releasing the sheds.

In order to effect a beat up of the weft thread by the leading surface 58 of the retainer 40, the retainers 40 are mounted with a torsional spring shown at 110 in FIG. 3 so as to apply a yieldable pressure to the weft thread. A rotation limit pin 112 extends through a slot in casing 113 to limit the amount of rotation of the assembly within casing 113 and permits the retainers 40 to be re-positioned in a vertical position. The level advance of each of the releasable retaining stations on the frame of the loom is facilitated by means of rollers 114, as seen in FIG. 3, in engagement with platform means 116 on the main frame of the loom.

In operation, the sheds are formed successively in substantially continuous manner and the retainers 40 inserted between adjacent warp threads as illustrated in station 28 in FIG. 4, and into the open shed formed by any conventional means. The retainers then partially rotate into the shed-retaining or closed position, whereupon the shed-forming means may immediately begin to form the succeeding shed by moving some or all of the warp threads, according to the weave pattern, into the opposite position in the shed. As the retainers 40 proceed away from the shed-forming means and the selected warp threads move downward or upward from their respective open-shed positions, the warp threads come into contact with the thread-engaging surfaces 50 and 54 of the retainers 40 as indicated at stations 26 and 24 in FIG. 4. This contact thus preserves the previous positioning of the warp threads by the shed-forming means and thus retains the previous shed in an open position as it is advanced toward the fell of the cloth. With the sheds in open position and with the guide means 60 having been introduced thereto immediately prior to the insertion of the retainers 40 a shuttle 66 carrying a weft thread may be inserted through the spaced jaws of the guide members 60 and propelled across the width of the loom in any desired manner.

As the releasable retaining station reaches the desired position near to the fell of the cloth, the shed is released by turning the retainer 40 to a position completely parallel with the warp threads, such a releasing position being indicated at station 22 in FIG. 4. As the conveyor drive progresses, the surface 58 of retainer 40 effects the beat up of the weft thread simultaneously across the entire width of the loom as is indicated at station 22*a* in FIG. 4. From this position onward, the beat up progresses and the torsional spring 110 permits the retainer 40 to slip beneath the fell of the cloth until it reaches a position where it no longer engages the weft thread such as is shown in station 22*b* in FIG. 4.

Figure 10:
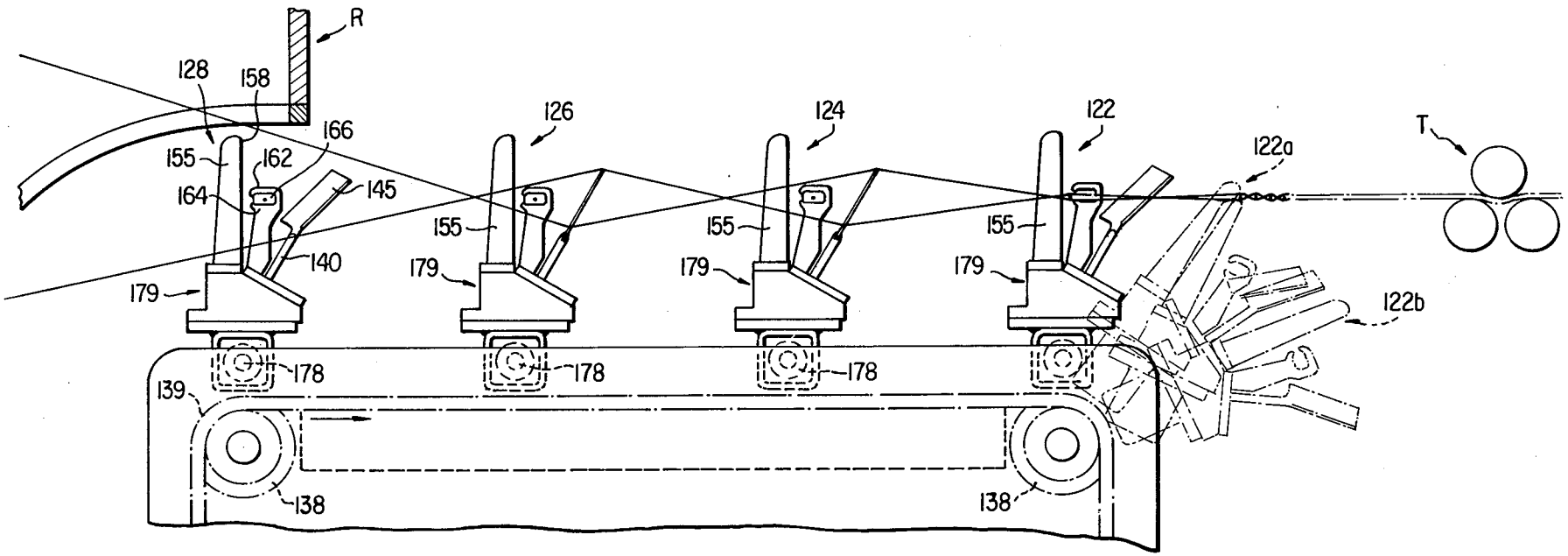
FIG. 10 is a fragmentary side elevational view of another embodiment of the present invention.
Figure 11:
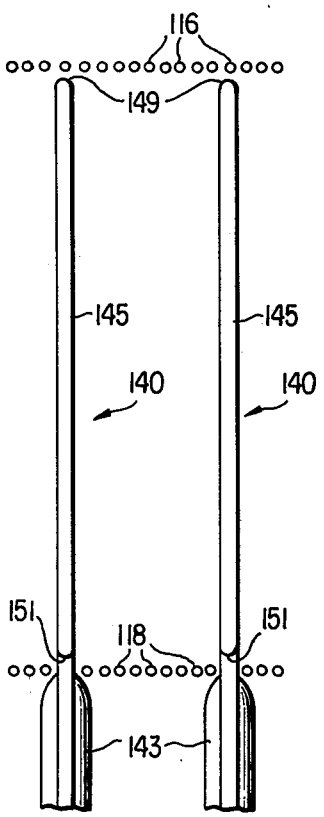
FIG. 11 is an elevational view of the shed-retaining means of FIG. 10 drawn to an enlarged scale.
Figure 13:
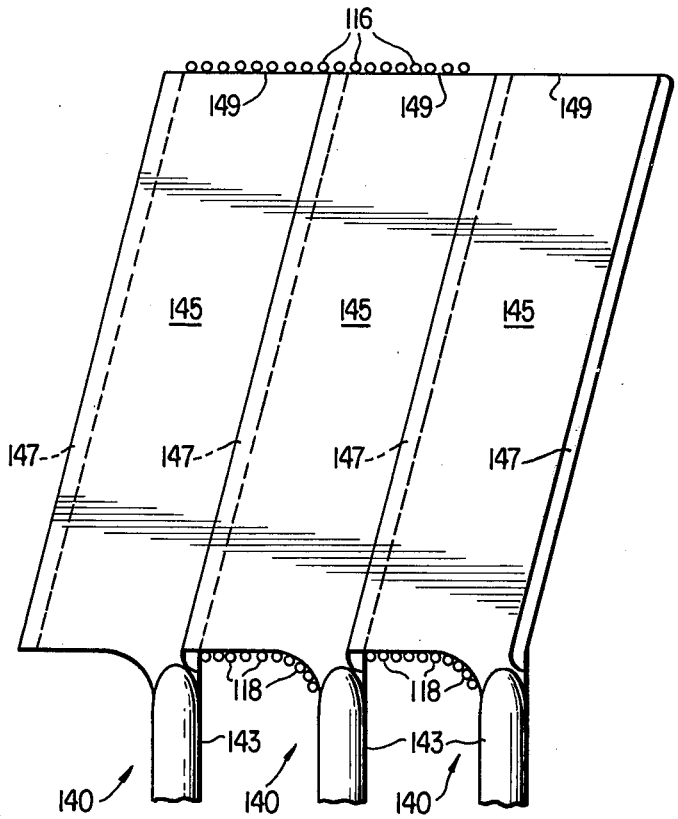
FIG. 13 is an elevational view of the shed-retaining means of FIG. 11 after they have been turned through 90°.
Figure 12:
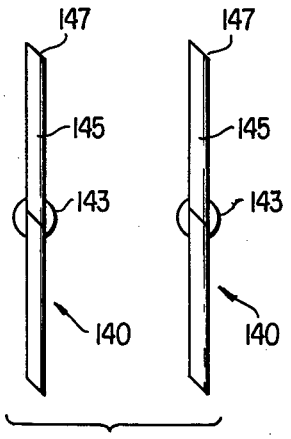
FIG. 12 is a top plan view of the shed-retaining means of FIG. 11.
Figure 14:
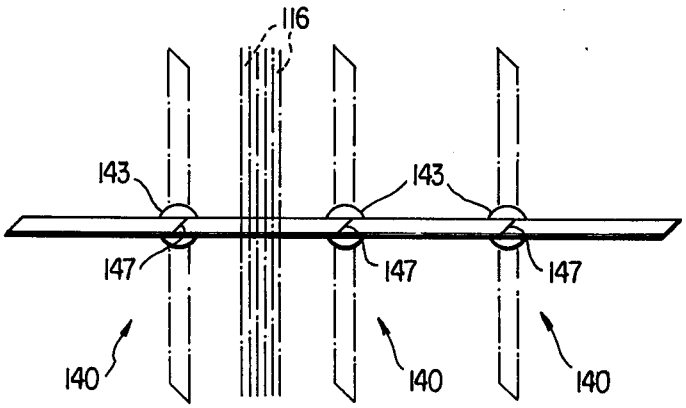
FIG. 14 is a top plan view of the shed-retaining means of FIG. 12 after they have been turned through 90°.
Figure 15:
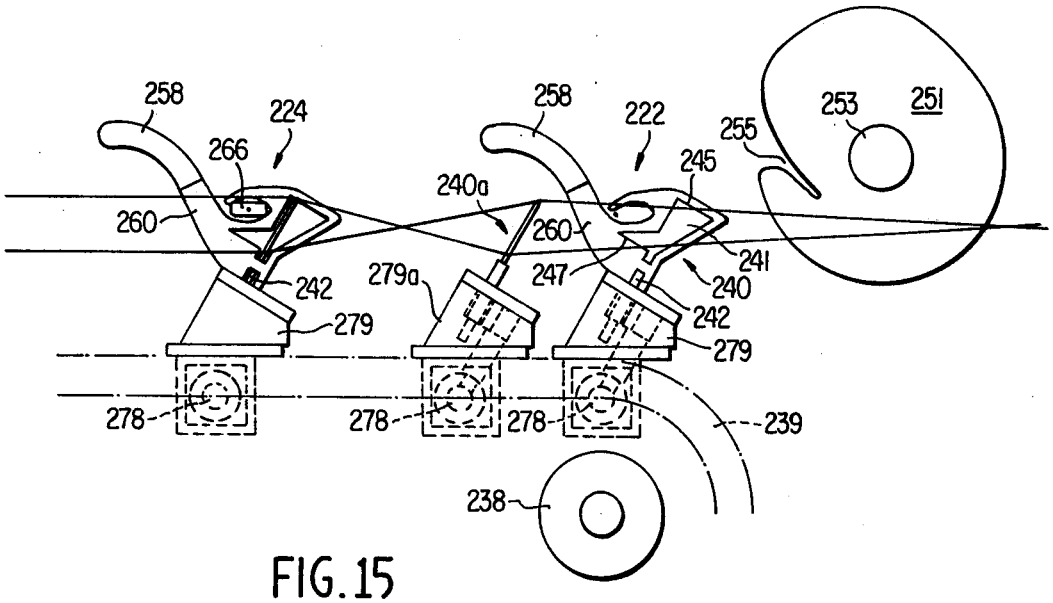
FIG. 15 is a fragmentary, side elevational view of another embodiment of the present invention.

A second embodiment of the invention is illustrated in FIGS. 10–14. Reference to FIG. 10 shows an arrangement generally similar to FIG. 4 with releasable shed-retaining stations indicated generally at 122, 124, 126 and 128. In this embodiment of the invention, the shed-retaining means 140, which will be described in more detail in connection with FIGS. 11 through 14, precede the guide members which support the shuttle. Reference to FIGS. 11–14 shows that the releasable retainer, indicated generally at 140, has a support 143 and a plate-like upper portion 145 which is introduced between open warp sheds generally parallel to the longitudinal axis of the warp threads themselves in the release or non-holding position. The plate-like upper portions have a beveled edge 147 which mate with a corresponding beveled portion on the opposite edge of the plate to form a wall or continuous flat plate to maintain the upper warp threads 116 in spaced relationship to the lower warp threads 118, as seen best in FIG. 13. As in the previous embodiment, each retainer 140 has an upper warp thread-engaging surface shown at 149 and a lower warp-thread-engaging surface shown at 151. When retainers 140 are in closed or shed-retaining position, surfaces 149 and 151 form continuous parallel level surfaces for the warp threads to bear upon, with the exception of the interruptions of the surface 151 due to supports 143. It will be noted in FIG. 10 that retainers 140 are disposed at an angle to the vertical toward the fell of the cloth. This angle, in conjunction with the angular disposition of plate 145 in relation to support 143 as seen in FIG. 13, allows the thread engaging surfaces 149 and 151—when the plates 145 are rotated and the shed is released—to pivot at an angle to the horizontal which is greater than the angle held by the warp threads. Thus plates 145 can rotate to release the shed without interfering with, or interference from, the warp threads which bear on said surfaces 149 and 151.

Figure 21:
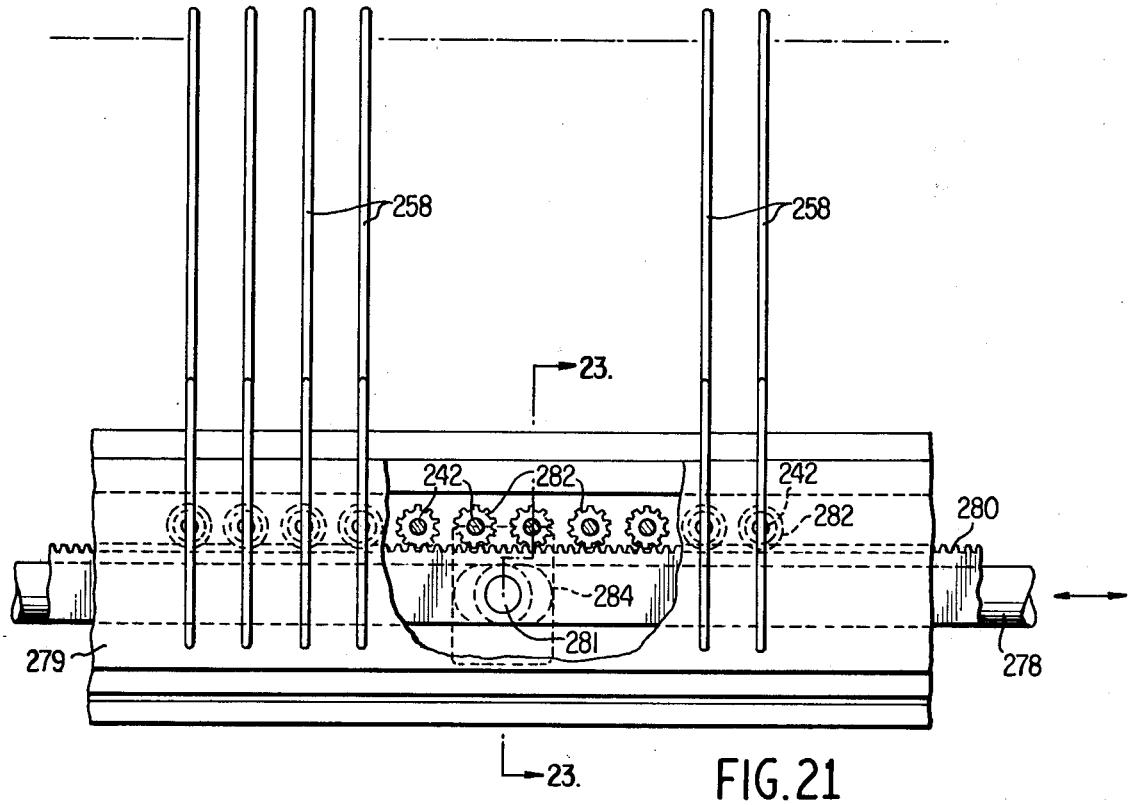
FIG. 21 is a fragmentary elevational view, with parts broken away, showing another means for rotating the shed retainers.
Figure 22:
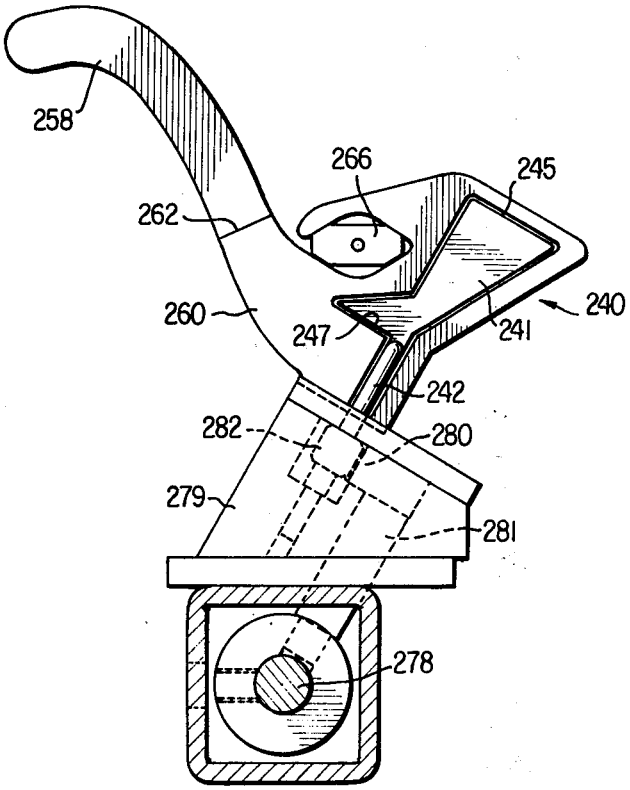
FIG. 22 is an elevational view, taken at right angles with respect to FIG. 21 and taken partially in vertical cross section.
Figure 23:
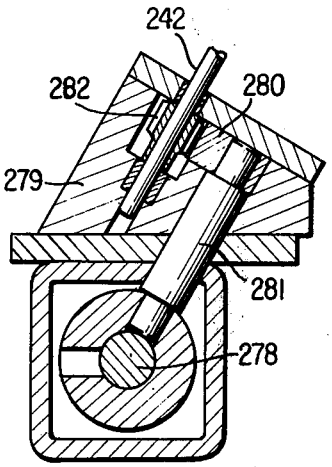
FIG. 23 is a fragmentary elevational view, taken in vertical cross section along line 23—23 of FIG. 21.

As in the previous embodiment, and with reference to FIG. 10, a suitable drive is imparted to sprockets 138 of a chain conveyor 139 on which the releasable shed-retaining stations 122, 124, 126, 128 and others are mounted. Reed R, as in the previous embodiment, effects preliminary lateral spacing of the warp threads such as are designated at 16 and 18. As in the previous embodiment, retainers 140 are inserted as in the station at 128 into the open shed with the plate-like upper surfaces 145 of the retainers generally parallel to the warp threads. In this embodiment, separate spring-mounted beat-up members 155, having beat-up surfaces 158, corresponding to surfaces 58 in the previous embodiment are suitably spring-mounted to effect beat up of the weft threads. In this embodiment, the guide members for the shuttle 166 have, as in the previous embodiment, an upper jaw 162 and a lower jaw 164 so spaced to receive the shuttle means 166 which carries the weft thread across the loom. As in the previous embodiment, the means for turning the retainers 140 may be taken directly from shaft 178 by suitable cam means or the movement imparting means may be mounted within a conscle indicated generally at 179 on which the releasable retainers 140 and the separate spring-mounted beat up means 155 and guide members are located. A specific embodiment for suitable movement imparting means is shown in FIGS. 21–23 and is described in greater detail hereinafter.

After insertion of the retainers 140 in the station at 128 they are turned to the position shown at station 126 wherein they are in a shed-holding position, as in FIG. 13. This position is maintained until a desired point is reached near to the fell of the cloth at which point the retainers are turned as shown at station 122 to release the shed. Beat-up is effected at station 122*a* as in the previous embodiment with the spring-mounted surfaces 158 yielding until they finally pass beneath the fell of the cloth and into a position indicated generally at 122*b*.

Figure 17:
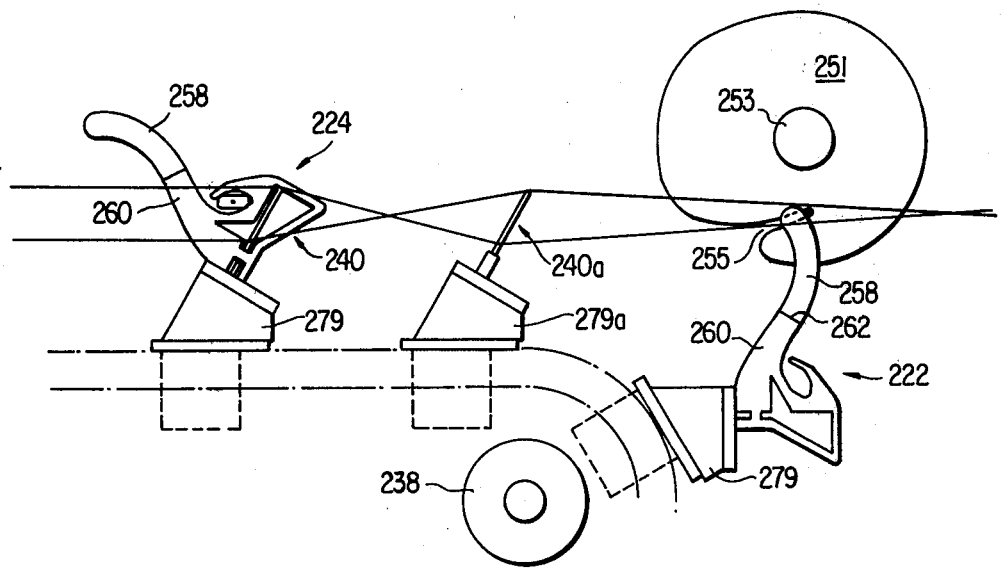
Figure 18:
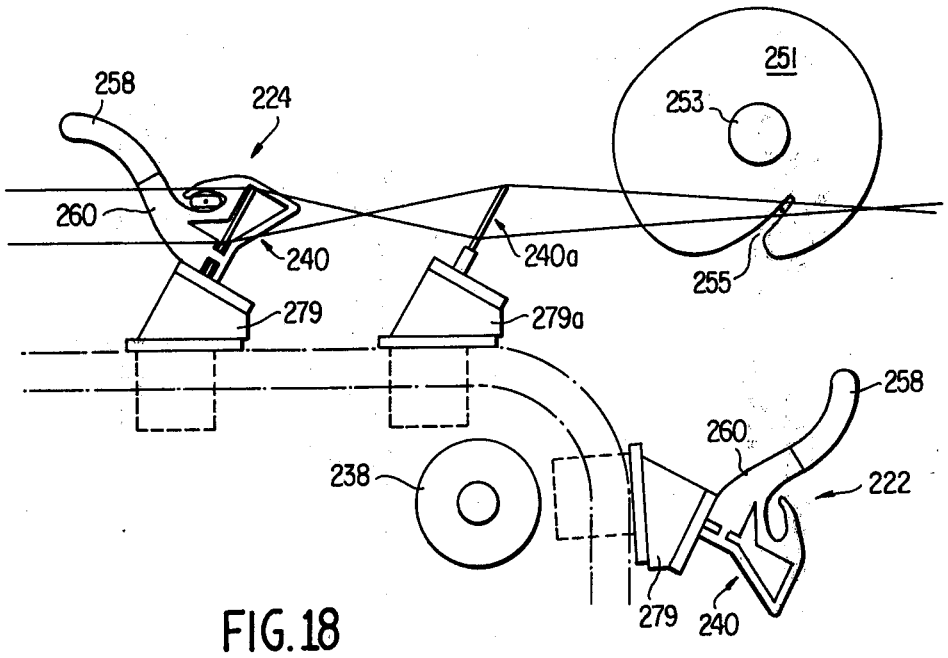
Figure 19:
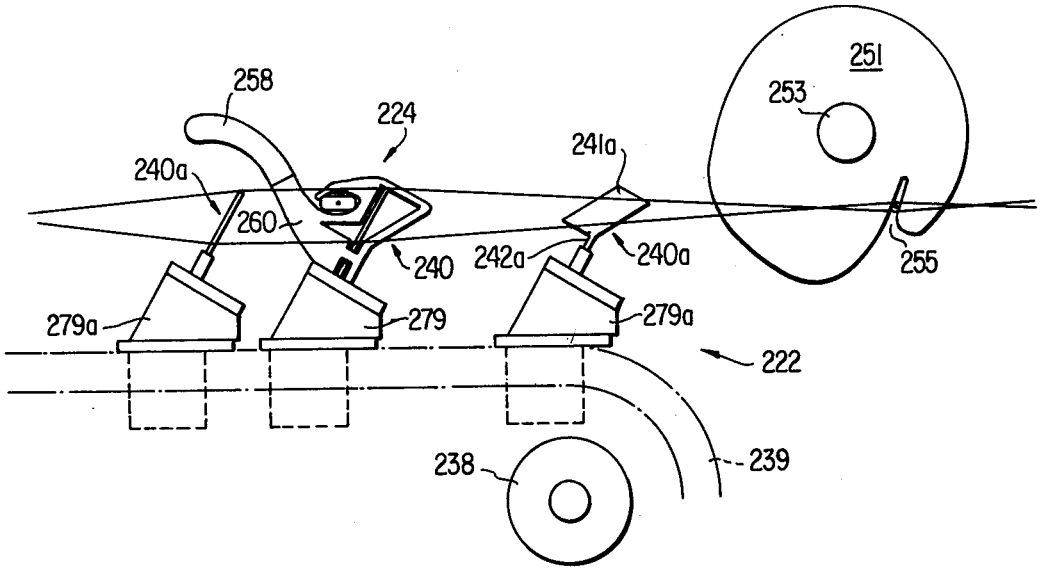
Figure 20:
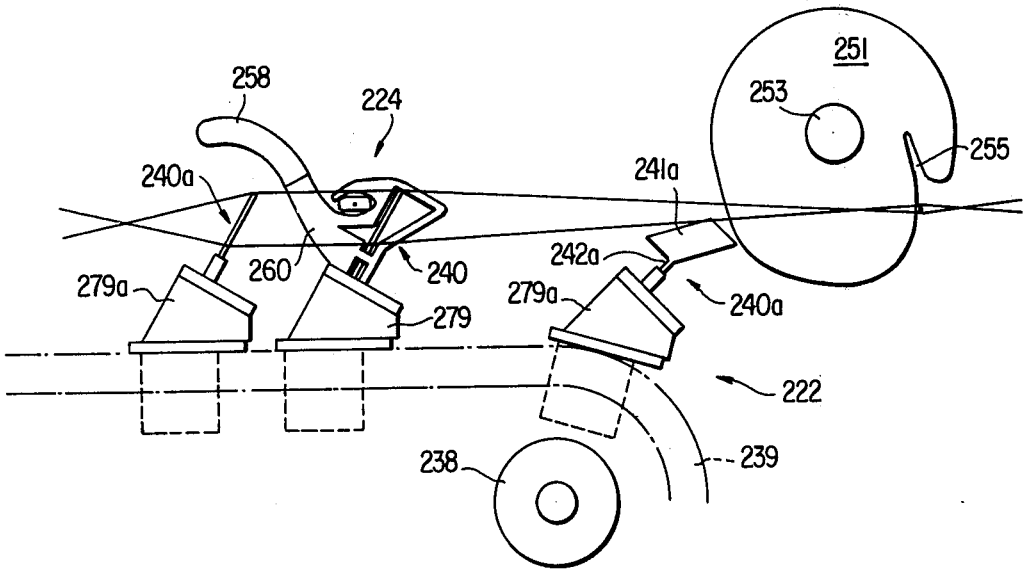

Reference is now made to FIGS. 15–20 which illustrate a third embodiment of the present invention. As in the previous embodiments, retaining stations are generally indicated at 222 and 224 in FIG. 15. Also, as in the previous embodiments, a conveyor means is used to propel the retaining stations from a point substantially immediately adjacent the shed formation to a point adjacent the fell of the cloth. To this end, a driven sprocket is shown at 238 and a chain conveyor indicated merely by the dashed lines at 239. In this embodiment of the invention, retainer 240 travels with the guide member 260 and a separate, independently operated retainer 240*a* for the same shed trails the guide member 260 and its associated independently operated retainer 240 for the same shed. Thus in FIG. 15 there is illustrated a releasable retainer indicated generally at 240 having a plate 241 carried by a rotatable support rod 242. As in the previous embodiments, the upper surface of plate 241 is engageable with a number of warp threads in raised position and the lower portion of plate 241 is engageable with a number of warp threads in depressed position to maintain the shed in open position. The upper surface of plate 241 is shown at 245 and the lower surface of plate 241 is shown at 247. The retainer 240*a* which is detailed in FIGS. 19 and 20 is functionally similar to retainer 240 which is detailed at station 222 in FIG. 15. In the FIGS. 19 and 20 representation the retainer 240*a* has a plate 241*a* mounted on a rotatable support rod 242*a*. Numeral 251 in FIGS. 15 through 20 designates a rotatable cam a series of which are stationarily mounted with respect to the frame and which serve as a rotary reed or rotary beat-up member and is of the type illustrated in my U.S. Pat. No. 3,056,430, issued Oct. 2, 1962. These rotary cams are mounted on shaft 253 in fixed position with respect to the loom and have weft thread-receiving slots at 255. Each rotary cam on reed 251 has a thin cross section so that it may pass between adjacent warp threads and space them laterally.

In this form of invention, the guide member carries the retainer 240 and as in previous forms of the invention includes an aperture for a shuttle 266 and is provided with a curved member 258 which advances the weft thread into slot 255 of the rotatable reed 251 for subsequent beat-up into the fell of the cloth. Once again, the rotation imparted to the retainers 240 and 240*a* may be made with the aid of stationary cams in the manner illustrated in the first embodiment of this invention. Shaft 278 may be engageable with cam means as in the first embodiment of the invention.

FIGS. 21–23 illustrate one suitable alternative means for effecting rotation of the releasable retainers 240 and 240*a* supported on consoles 279 and 279*a*, respectively. These consoles contain means for rotating the retainers identical with consoles 179 in FIG. 10. Thus shaft 278 is made reciprocable by any suitable means such as the cam means 72 of the first embodiment. Shaft 278 carries a rack 280 with a plurality of drive pins 281 interconnecting shaft 278 with rack 280. Each rotatable support rod 242 carries a spur gear 282 which meshes with rack 280 and is rotated thereby. Slot 284, shown in FIG. 21, permits drive pins 281 to be reciprocated in a direction parallel to the longitudinal axis of shaft 278.

FIGS. 15 through 20 shows progressive steps in the operation of the loom. Thus, in FIG. 15 at station 222, retainers 240 have been opened and no longer retain the shed at that position. However, at 240*a* of station 222 the retainers remain closed, thereby holding the same shed open at that position. Similarly, the following shed is maintained open by retainer 240 at station 224. The rotary beat-up member 251 has completed the beat-up of the previous weft thread and is continuing to rotate thereby bringing slot 255 into position to receive the next weft thread.

Figure 16:
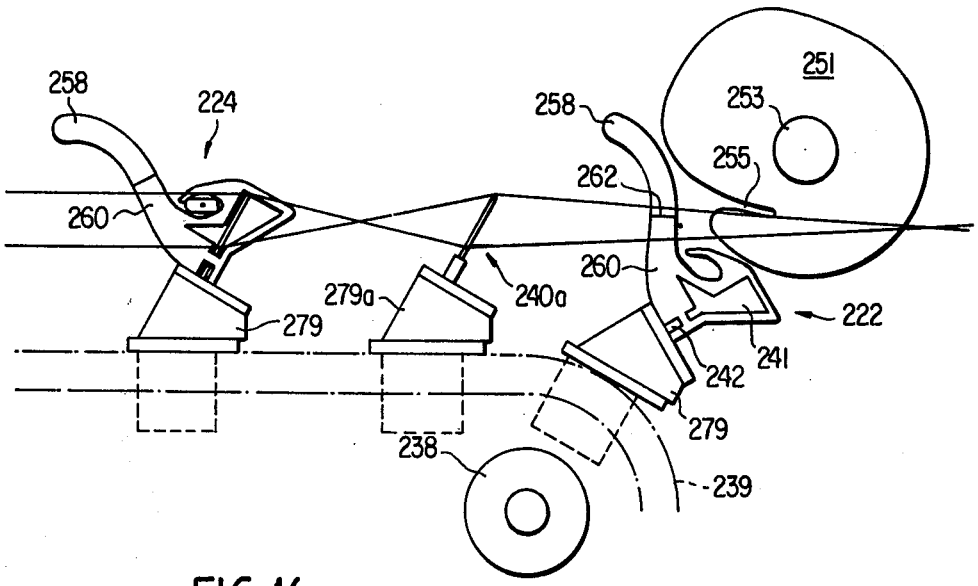
FIGS. 16 through 20 are fragmentary side elevational views similar to FIG. 15 but showing sequentially different positions in the weaving process.

Moving on to FIG. 16, the retainers 240 have moved out of the way and the weft thread *w* at that station is under the control of curved surface 258 delivering the weft thread to the weft-thread-receiving slot 255 of the rotary beat-up member 251. The auxiliary retainer 240*a* at station 222 remains closed to preserve the shed as does the retainer 240 to preserve the following shed at station 224. Line 262 designates a change of section for the curved surface 258 with the outermost section being a thinner cross section so that in the position of FIGS. 16 and 17 the outermost portion of curved surface 258 freely passes between adjacent thin cams of reed 251.

In the FIG. 17 position, at station 222 the curved surface 258 has delivered the weft thread under the control of the slot 255 in rotary beat up member 251 while retainer 240*a* of station 222 and member 240 at station 224 remain closed thereby preserving the sheds.

In the position illustrated in FIG. 18 at station 222 the surface 258 has moved completely out of contact with the weft thread and the beat-up is effected solely by the rotary beat-up member 251. The auxiliary retainer 240*a* associated with station 222 remains in shed-retaining position as does the retainer 240 at station 224.

The use of two independently controlled retainers for each shed has several advantages, one of which is a smaller height of shed-opening. Also, this third embodiment, as does the second embodiment, assures a clear shed opening for the weft-laying means by having retainers precede the weft thread in the shed being held. Again, this third embodiment, by also having a retainer following the weft-laying means and the weft member as does the first embodiment, gives greater latitude in selecting the instant of shed release in relation to the instant of weft beat-up, affording adjustments in what is known as the "timing" of the beat-up.

In the FIG. 19 illustration the auxiliary retainer 240*a* associated with station 222 has been rotated through 90 degrees thereby releasing the shed while the retainers 240 and 240*a* at station 224 remain in the shed-retaining position. The beat-up by the rotary beat-up member 251 is about ready to begin in FIG. 19.

In FIG. 20 the beat up by the rotary beat-up member 251 is being effected while the auxiliary retainer 240*a* at station 222 passes out from under the warp threads with the retainers 240 and 240*a* at station 224 remaining closed in shed-retaining position.

WEFT INSERTING MEANS

Figure 24:
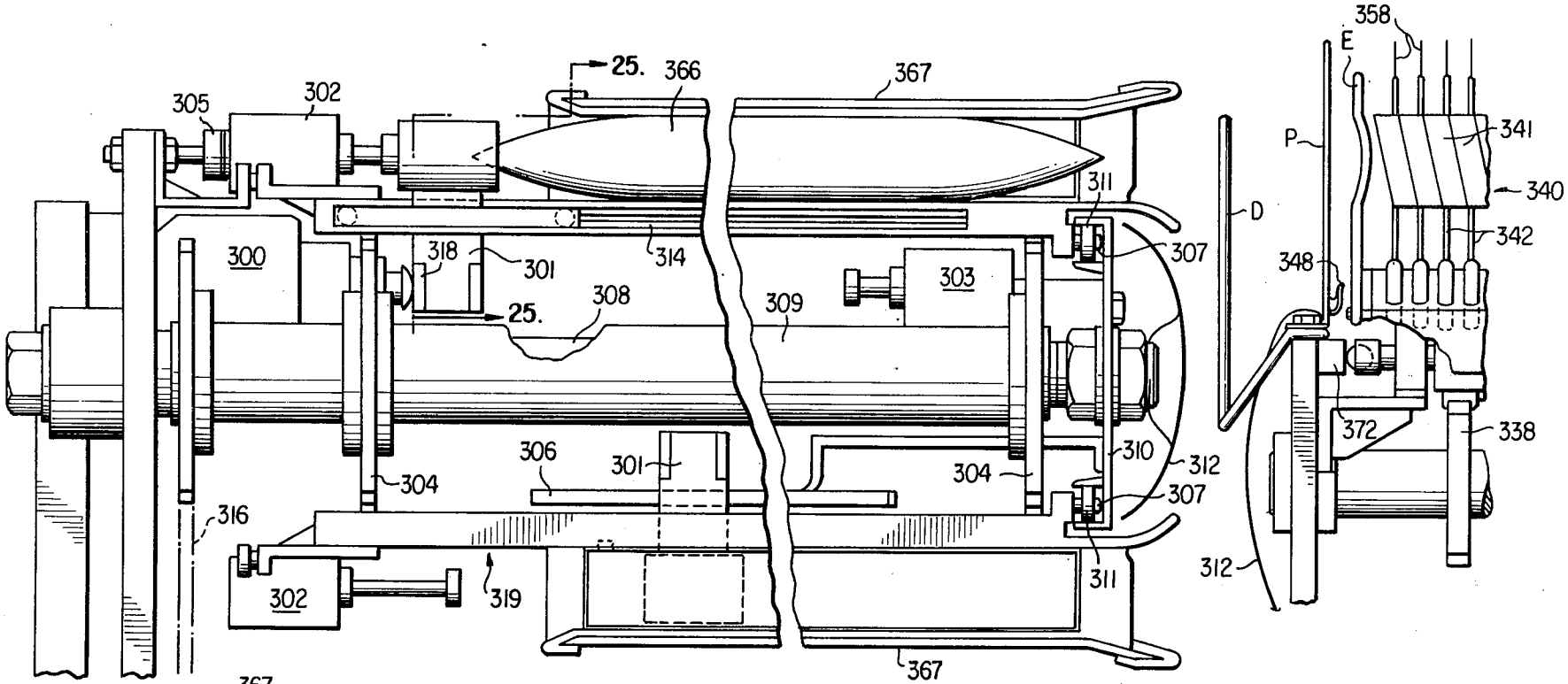
FIG. 24 is a fragmentary elevational view illustrating weft inserting means on one side of a loom and its position with respect to said retaining means made in accordance with another embodiment of the present invention.
Figure 25:
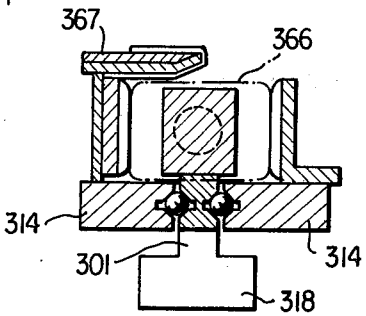
FIG. 25 is an elevational view taken in vertical cross section along line 25—25 of FIG. 24.

Reference is made to FIGS. 24 and 25 for an illustration of a preferred form of weft thread inserting means illustrating the use of conventional-type shuttles in accordance with the present invention. FIG. 24 shows a weft inserting means located on one side of the loom with a counterpart thereto, not shown, being on the other side. A picking cylinder 300 has a piston engageable with a picking cart or carriage 301 in order to transmit power from the picking cylinder 300 to a shuttle 366 within a shuttle box 367. As defined herein, the stationarily mounted picking cylinder 300 together with the movably mounted picking cart or carriage 301 constitute picking means. Contact plates 318 on picking cart 301 present a relatively large area for engagement by the piston of the picking cylinder 300. The picking cart or carriage 301 is supported while traveling from left to right in FIG. 24 by guide means 314 seen also in FIG. 25. Guide 314 guides and supports the shuttle during the initial stage of its flight laterally of the weft inserting means and out of shuttle box 367. A cart or catapult check 303 stops the cart 301 after it has thrown shuttle 366. Numeral 304 designates sprockets for the weft thread inserting means conveyor indicated generally at 319. Each shuttle box 367 also receives a shuttle at the end of its flight across the loom. Because a shuttle is thrown alternately from either side of the loom, alternate shuttle boxes 367 receive a shuttle at the end of its flight across the loom. A backstop or support 305, in a fixed position on the frame of the loom in the area wherein the shuttle returns, receives the thrust from the deceleration of the shuttle. A stationary cam 306 mounted adjacent the lower flight of conveyor 319 in FIG. 24 serves to reposition the empty picking cart or carriage 301 by moving it to the left in contact with a shuttle check or buffer 302. Thrust bearings or rollers are illustrated at 307 suitably positioned to receive the thrust during the throwing of the shuttle 366. A cantilevered inner shaft 308 is stationarily mounted on each side of the loom, whereas shaft 309 is concentric therewith and rotates around shaft 308 and is supported thereby. Complementary structure exists on the other side of the loom, but for convenience of illustration, only one side is shown. Each shuttle box conveyor 319 is driven in synchronism with the shed-retaining conveyor in the center of the loom. A frame piece 310 is stationary and connects the ends of cantilevered shafts 308 to form a box for rigidity and to afford a platform for rollers 311.

Figure 30A:
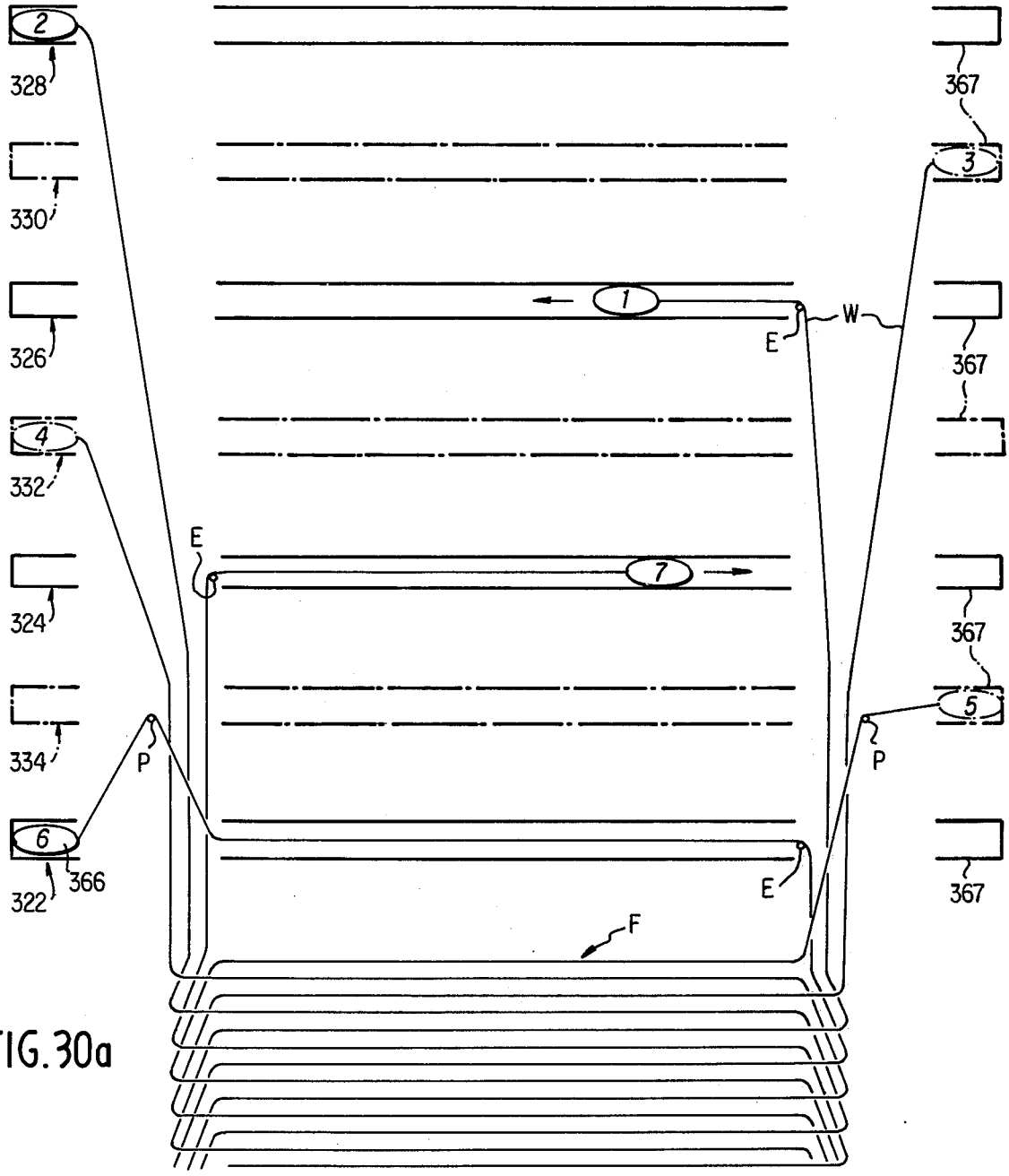
Figure 30B:
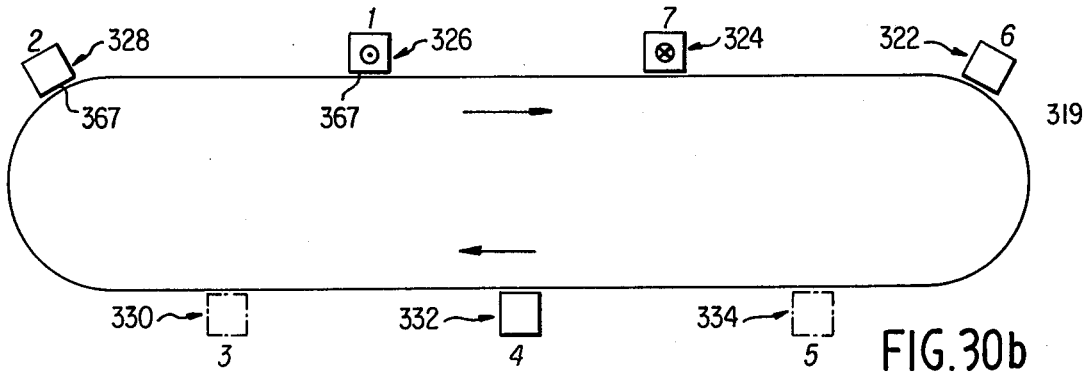
Figure 30C:
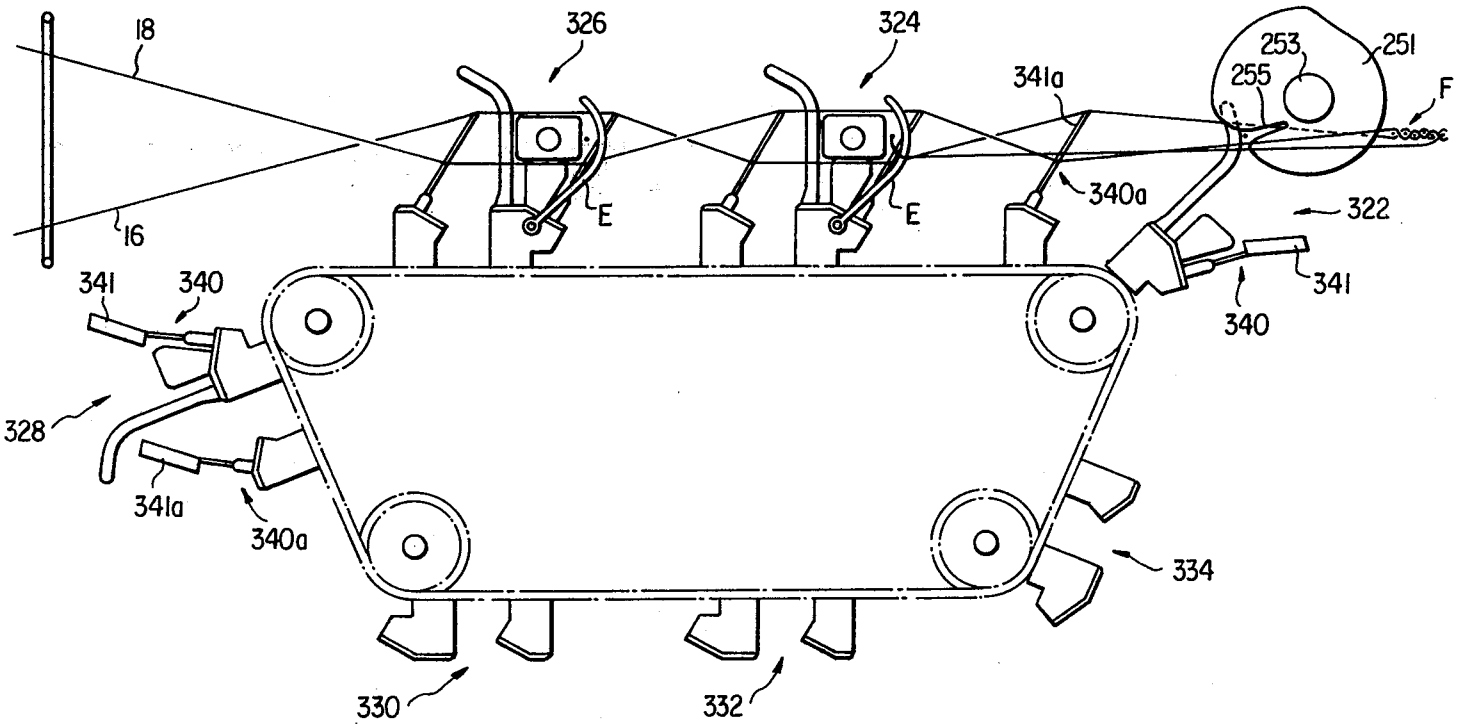
Figure 30D:
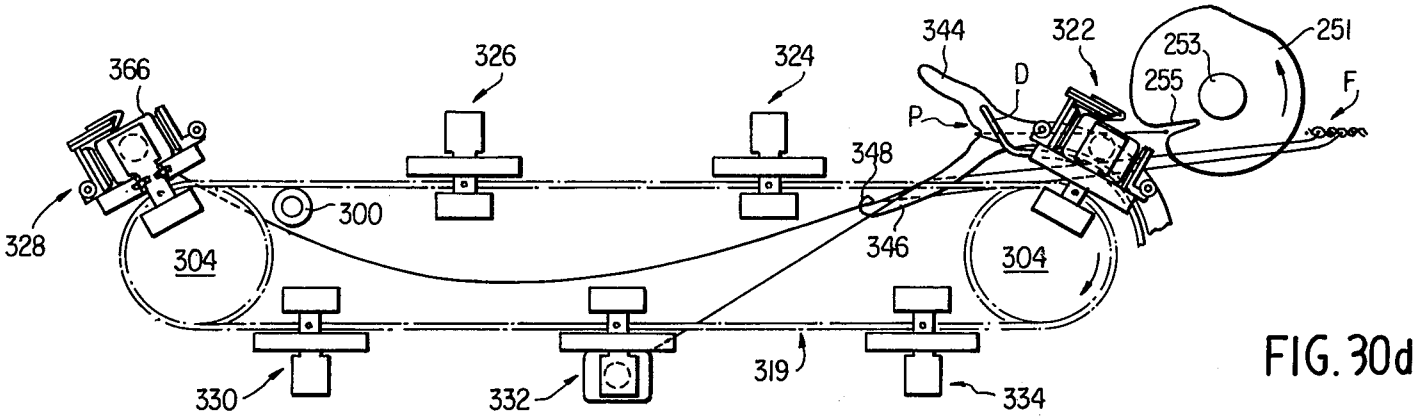
Figure 31D:
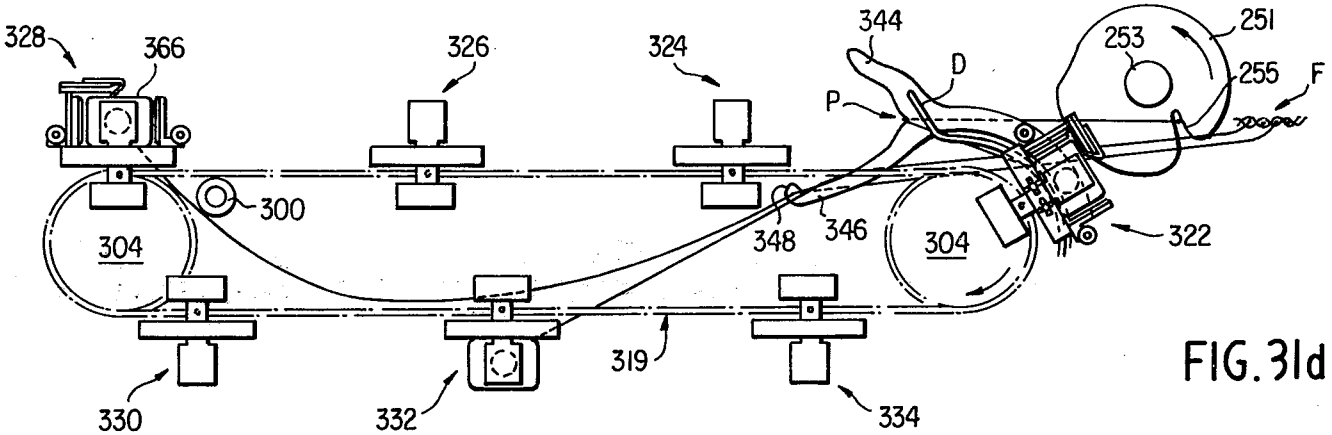
Figure 31A:
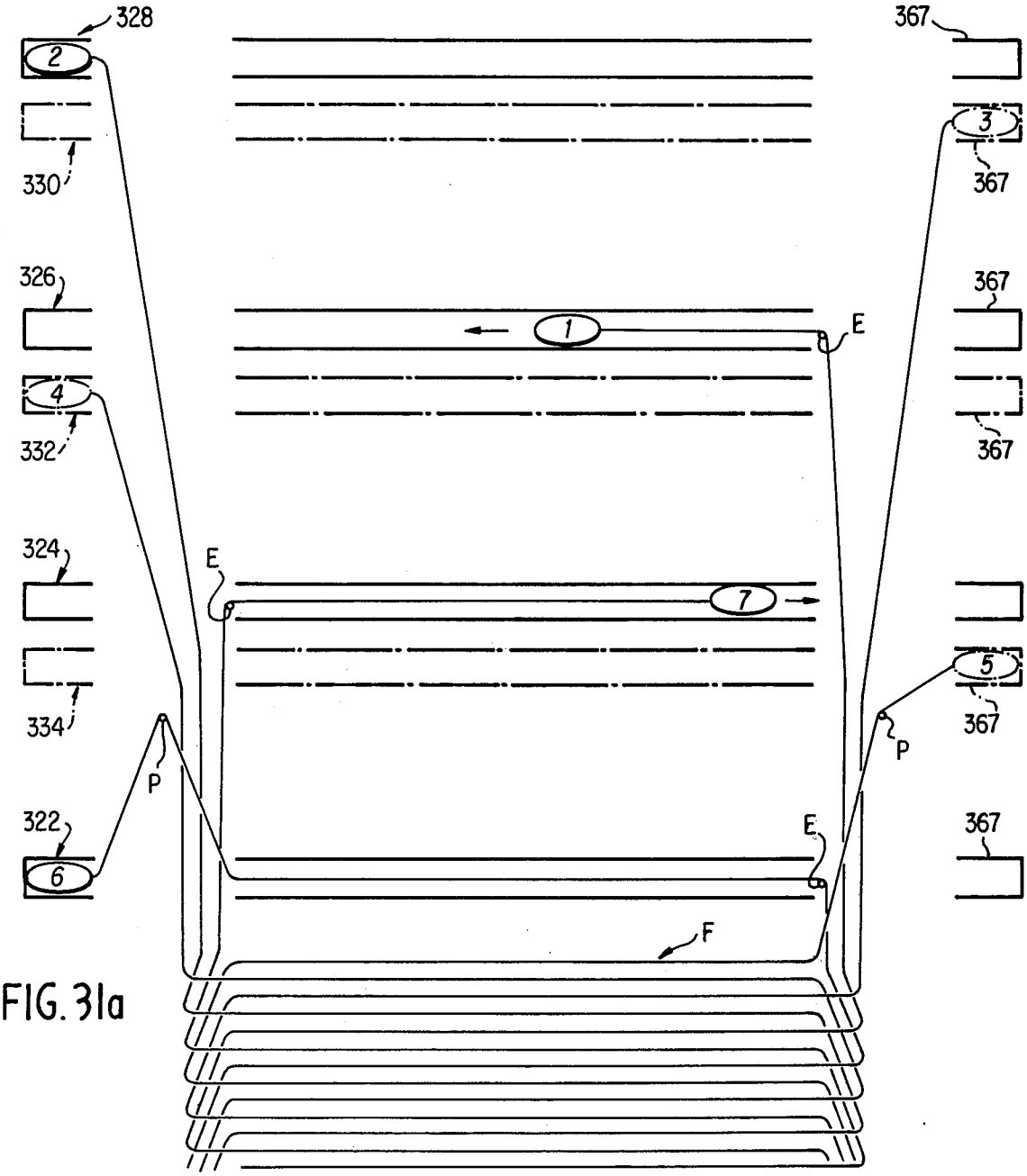
Figure 31B:
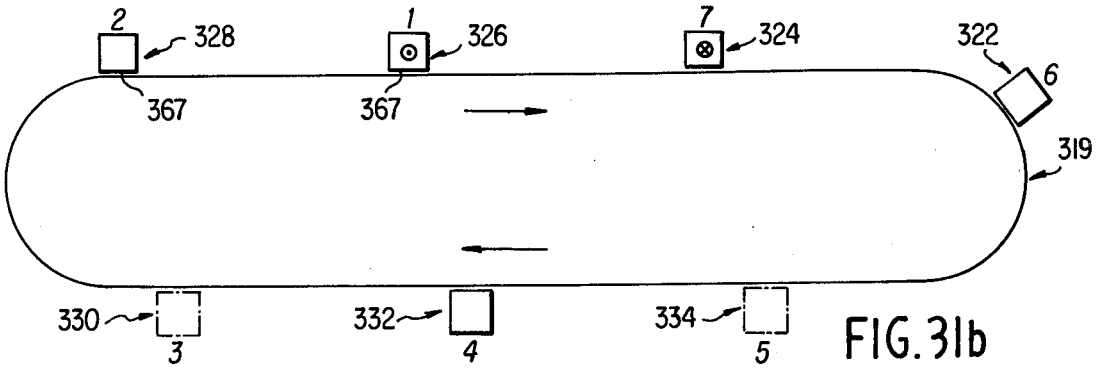

It becomes necessary to provide adequate guides for the weft threads and for this purpose, a stationary tensioning guide member is shown at P in FIG. 24, and FIGS. **26*d*–31*d* with the most unencumbered showing being in FIGS. 30*d* and 31*d*. Tension is maintained on the weft thread from the time the shuttles are fired until the time of beat-up of the weft threads into the fell of the cloth. Each tensioning guide P has an upper arm 344, a lower arm 346 and a hook 348 at the lower extremity of lower arm 346. Also provided on the outermost end of each side of the retainer members 340 is a weft thread end guide E serving to guide the trailing weft thread as the shuttle travels across the loom and to cooperate in maintaining tension. A weft thread depressing guide D functions to ensure that as each weft thread enters the crevice between the upper and lower arms 344 and 346 of tensioing guide P, it is also guided downward to the bottom plate of shuttle box 367, so that the weft thread cannot tangle or wrap itself around the nose of the shuttle as the shuttle box 367** turns 180° and reverses direction.

Covers or guards 312 are placed over the rotating shafts to ensure that the weft threads will not become entangled thereby. The shed retainers are indicated generally at 340 in FIG. 24 with shed retainer plates 341 which function in a manner described in previous embodiments of this invention. Rotatable support rods for the shed retainers are shown at 342. The sprockets driving the retaining apparatus is shown at 338 and numeral 372 indicates the location of stationary cam member.

The operation of the weft thread inserting means will best be understood by reference to FIGS. **26*a*–31*a* which schematically represent in plan view the weft thread positions with respect to the shuttle boxes 367 with each successive view showing an incremental advance over the previous view. FIGS. 26*b* through 31*b* illustrate the corresponding positions of the shuttle boxes 367 shown in side elevation. FIGS. 26*c* through 31*c* illustrate the movements of the retainers 340 and 340*a* which in general are similar to the third embodiment shown in FIGS. 15–20 but which also include the weft thread and guides E at the outermost end of each of the shed retainers 340**. For convenience of illustration in these views, not every station is fully illustrated, however, seven stations are present. It is significant in this form of the invention that an odd number of stations be employed in that the shuttles are fired alternately from opposite sides of the loom. Therefore, it becomes possible to have a shuttle fired alternately from each side of the loom, since a shuttle is fired from every second shuttle box which passes a picking cylinder on either side of the loom.

Referring now to FIGS. **26*a*–31*a*, and 26*b*–31*b*, the progression of the shuttles across the loom and the general sequence of events can be observed. For example, in FIG. 26*a* shuttle #1 has just been fired by the apparatus of FIG. 24 and is progressing across the loom from right to left toward its empty shuttle box at station 326. At this same time, shuttle #2 in station 328 is in its shuttle box and is moving away from the fell of the cloth F on the lower flight of the shuttle box conveyor 319. Shuttle #3 at station 330 is also moving away from the fell of the cloth F and is in its shuttle box 367 on the right hand side of the loom and is moving away from the cloth F with the weft thread being guided by the lower leg 346 of tensioning guide P as illustrated in FIG. 26*d*. Shuttle #5 at station 334 has already had its weft thread beat up into the fell of the cloth F and its weft thread is being guided by tensioning guide P on the right side of the loom. This position is remote from the observer in FIG. 26*d*, and for this reason is not shown in FIG. 26*d*. However, the position of shuttle #5 can be observed schematically in FIG. 26*a* with the weft thread associated with shuttle #5** being tensioned by the tensioning guide P.

Shuttle #6 at station 332 is the latest arrival of a shuttle into its associated shuttle box and it has not yet been beat up into the fell of the cloth nor has it yet engaged the crevice between the upper leg 344 and lower leg 346 of tensioning guide P. Shuttle #7 at station 324 has already been catapulted from left to right and has progressed slightly more than half way across the loom with the weft thread being guided by weft thread end guide E.

Figure 26A:
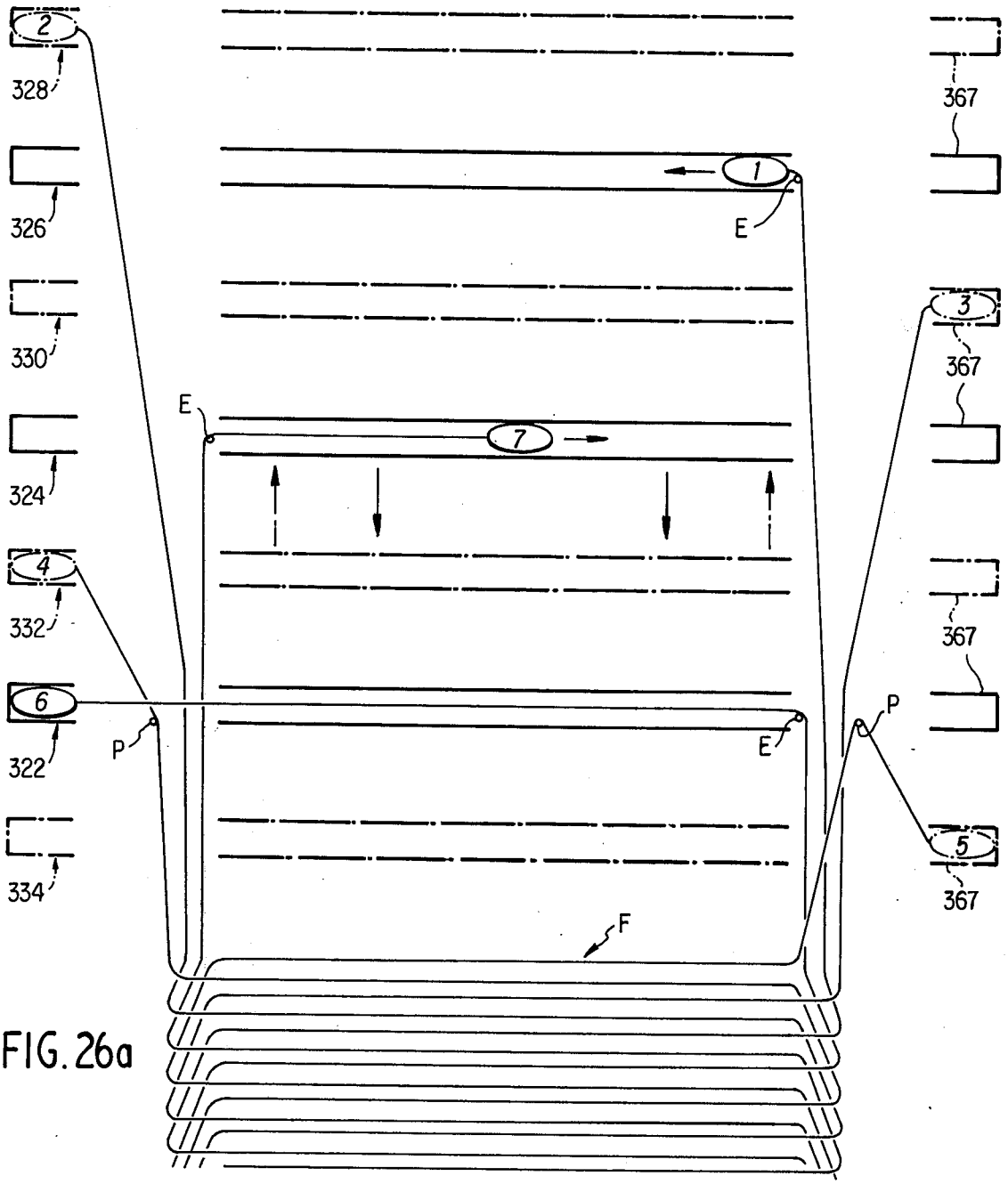
Figure 26B:
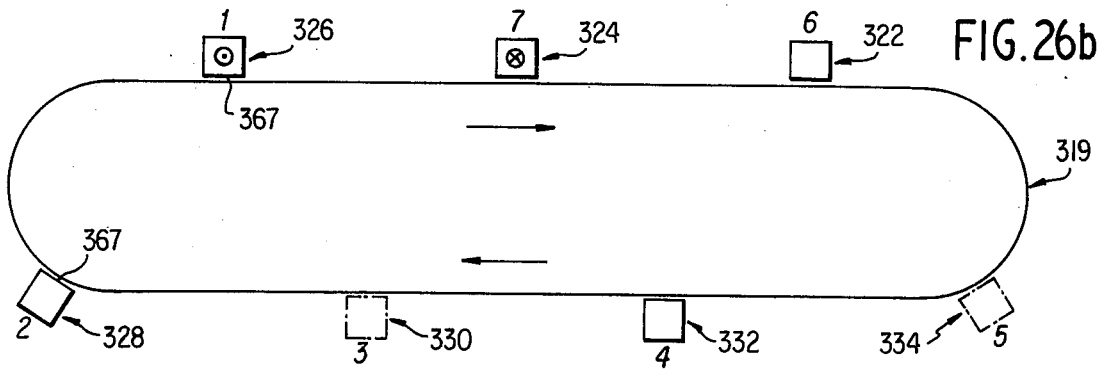
Figure 26C:
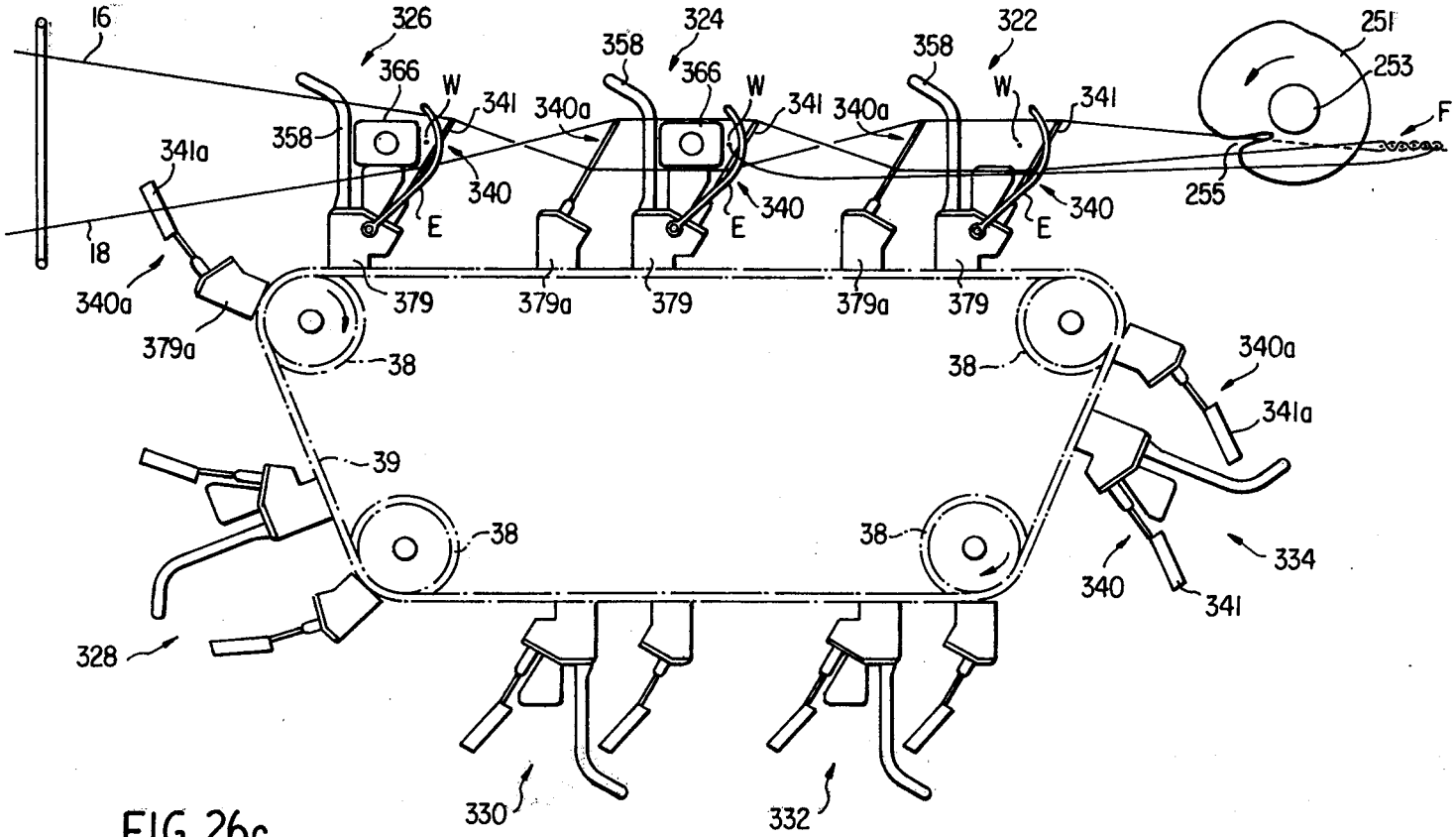
Figure 26D:
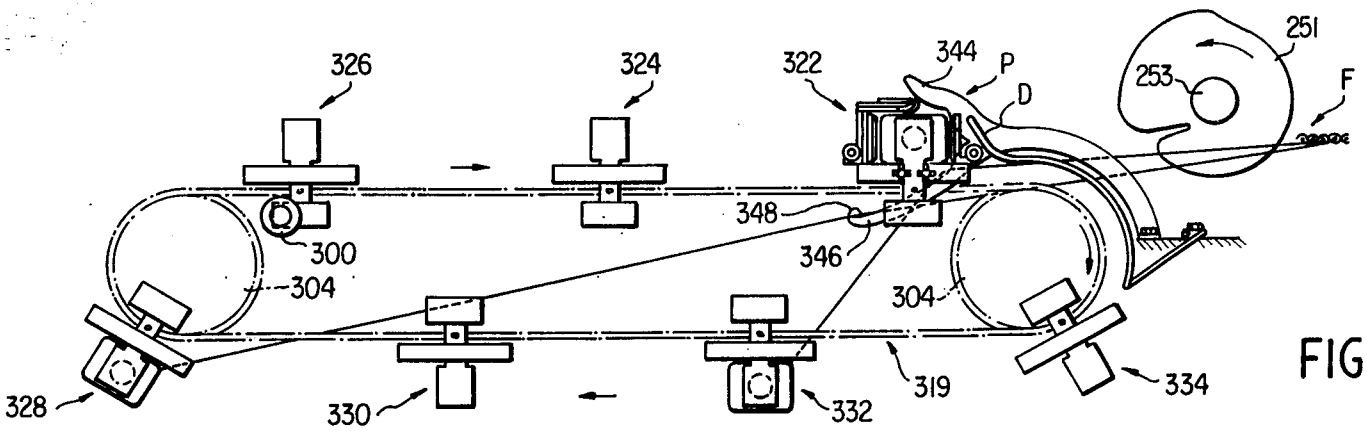
Figure 27D:
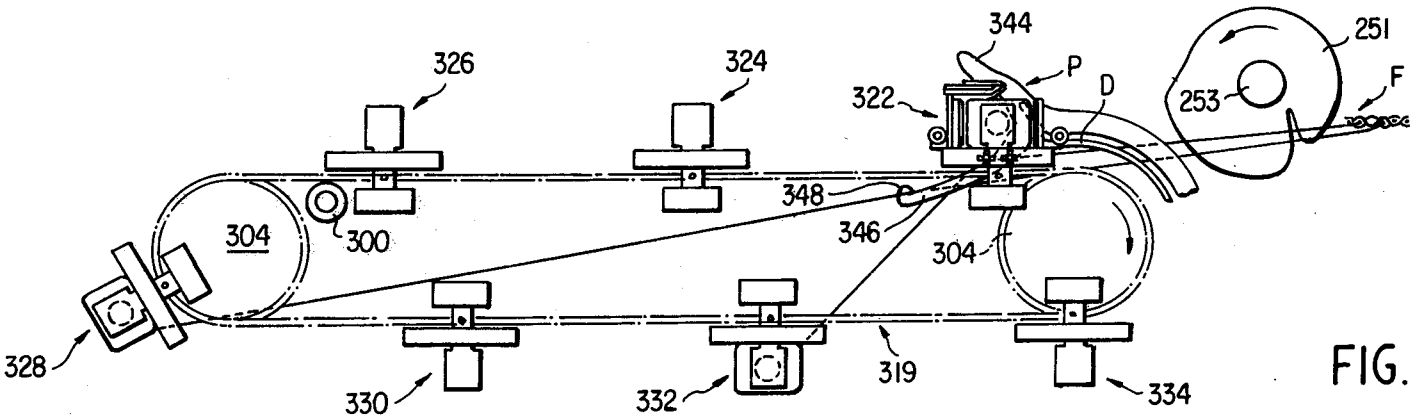
Figure 27A:
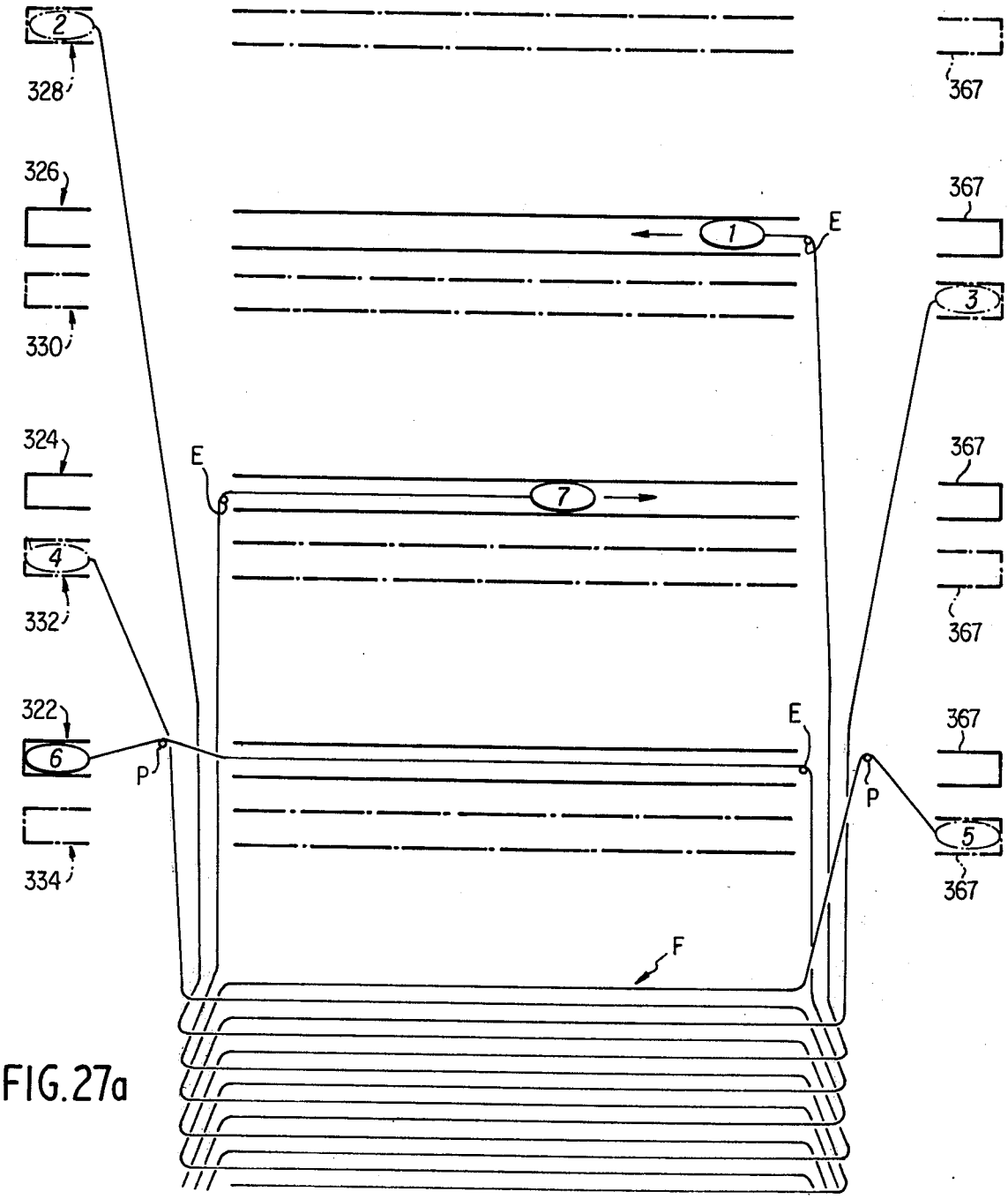
Figure 27B:
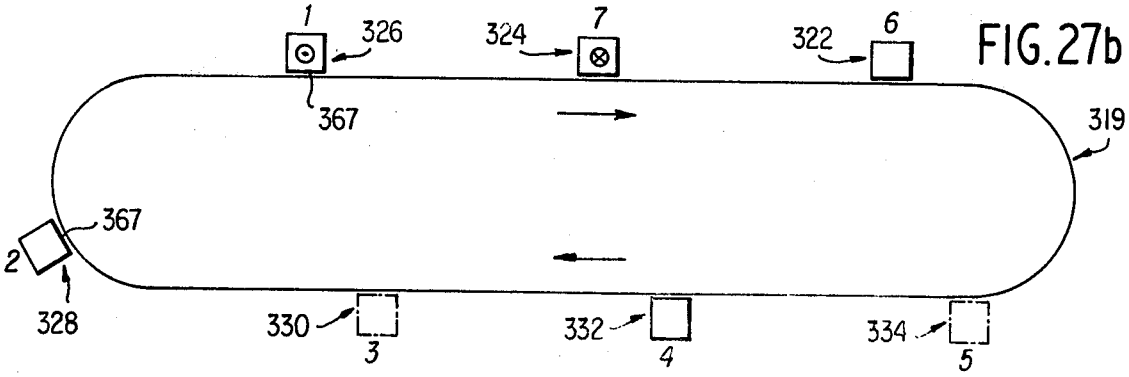
Figure 28A:
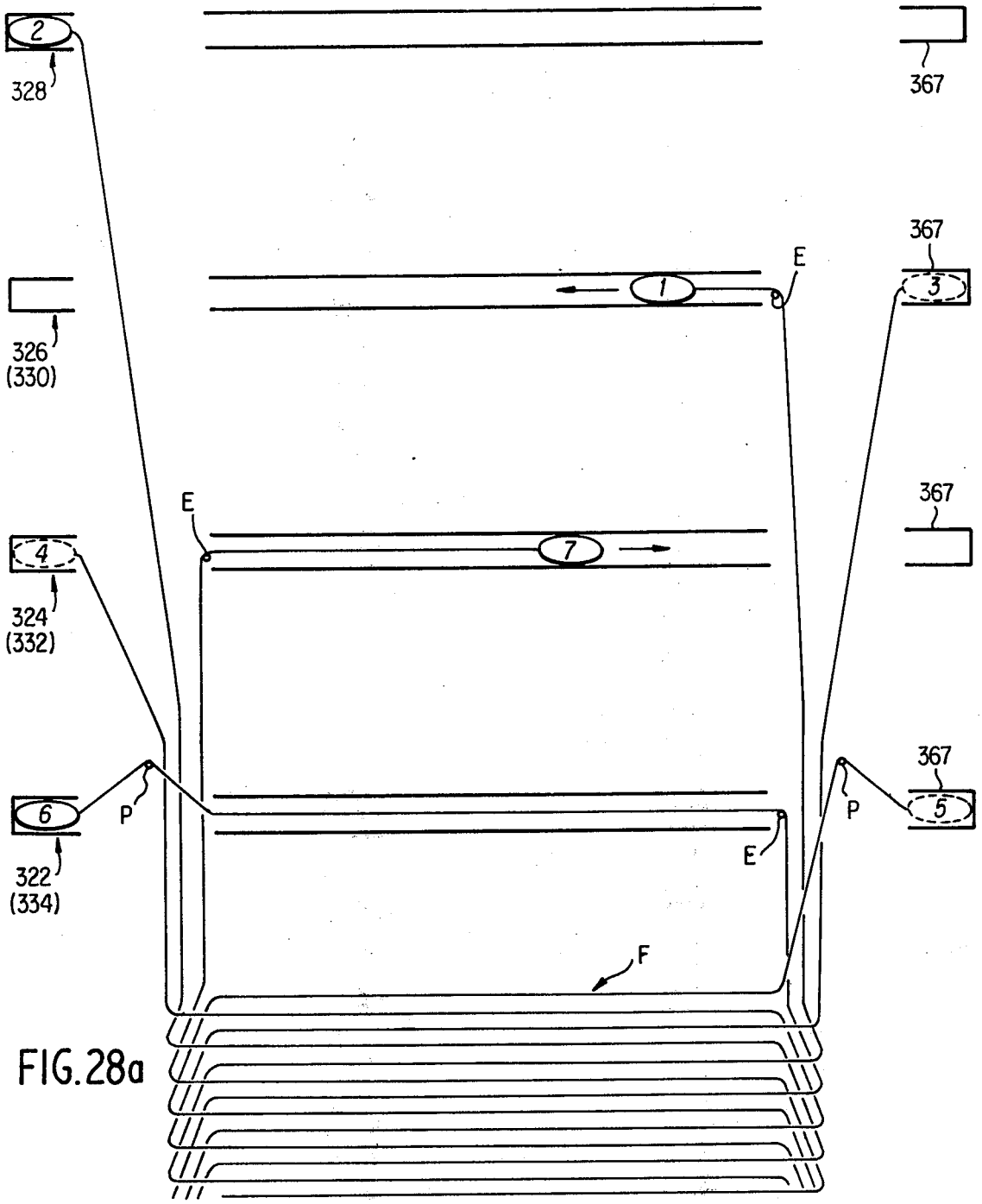
Figure 28B:
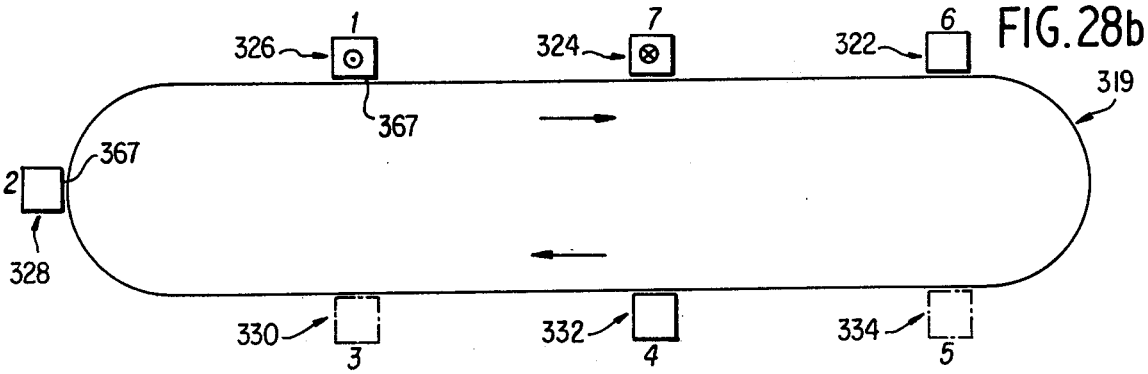

An incremental advance for all shuttles is shown in FIG. **27*a* as compared to FIG. 26*a*. In FIG. 27*a* it will be observed that shuttle #6 has now engaged the crevice between the legs of the tensioning guide P and is being tensioned thereby. FIG. 28*a* shows the next incremental advance in which shuttle #1 is substantially over the position of shuttle #3 and shuttle #7 is directly over the position of shuttle #4 and shuttle #6 is directly over the position of shuttle #5. The continued tensioning of the weft thread for shuttle #6 is illustrated as shuttle #6 approaches the fell of the cloth F. Additional and progressive incremental positions of the shuttles are shown at FIGS. 29*a*–31*a* with the corresponding positions of their shuttle boxes shown in FIGS. 29*b*–31*b***.

The primary function of tensioning guides P is, through its tension-preserving effect, to make certain that the weft thread slides transversely through the complete width of the shed during the entire interval between the time the weft first contacts guide P and the time the weft is beaten-up into the fell of the fabric. As can be seen in FIGS. 27*a* to 31*a* by observing the weft thread supplied by shuttle #6, as the weft thread continues to be advanced after the shuttle has stopped, the continued tension ensures that the length of weft thread extending from the fell to pin E, FIG. 27*a*, becomes transferred to the other side by a sliding action until it extends from the fell to P on the opposite side as is nearly completed in FIG. 31*a*. To further ensure that this result is achieved, a mechanically operated weft thread clamp could be positioned at the notch or crevice of guide P to provide positive clamping action on the weft thread until beat-up, after which the clamp would release the weft to slide down lower arm 346 as previously noted. Clamps of this type are well-known in the art and are not specifically illustrated herein.

Turning now to FIGS. 26*c*–31*c*, it is possible to observe what is happening on the shed retainer conveyor for positions corresponding respectively to FIGS. 26*a*–31*a*. Thus in FIG. 26*c* a follow up retainer 340*a* for station 326 is just entering the shed between warp threads 16 and 18. At station 326 the shed retainer plates 341 of the leading shed retainer 340 have been closed and the shed is being retained in open position. At stations 324 and 322, both pairs of shed retainers 340 and 340*a* are in shed-retaining position. At station 334, both shed retainers 340 and 340*a* have been turned and they will remain in this position until they enter the sheds immediately prior to the firing of the shuttle. Shuttles 366 are illustrated in transit in stations 326 and 324. The weft thread which is pulled from the side of the shuttles 366 is indicated by the letter *w* in each of these stations.

Figure 27C:
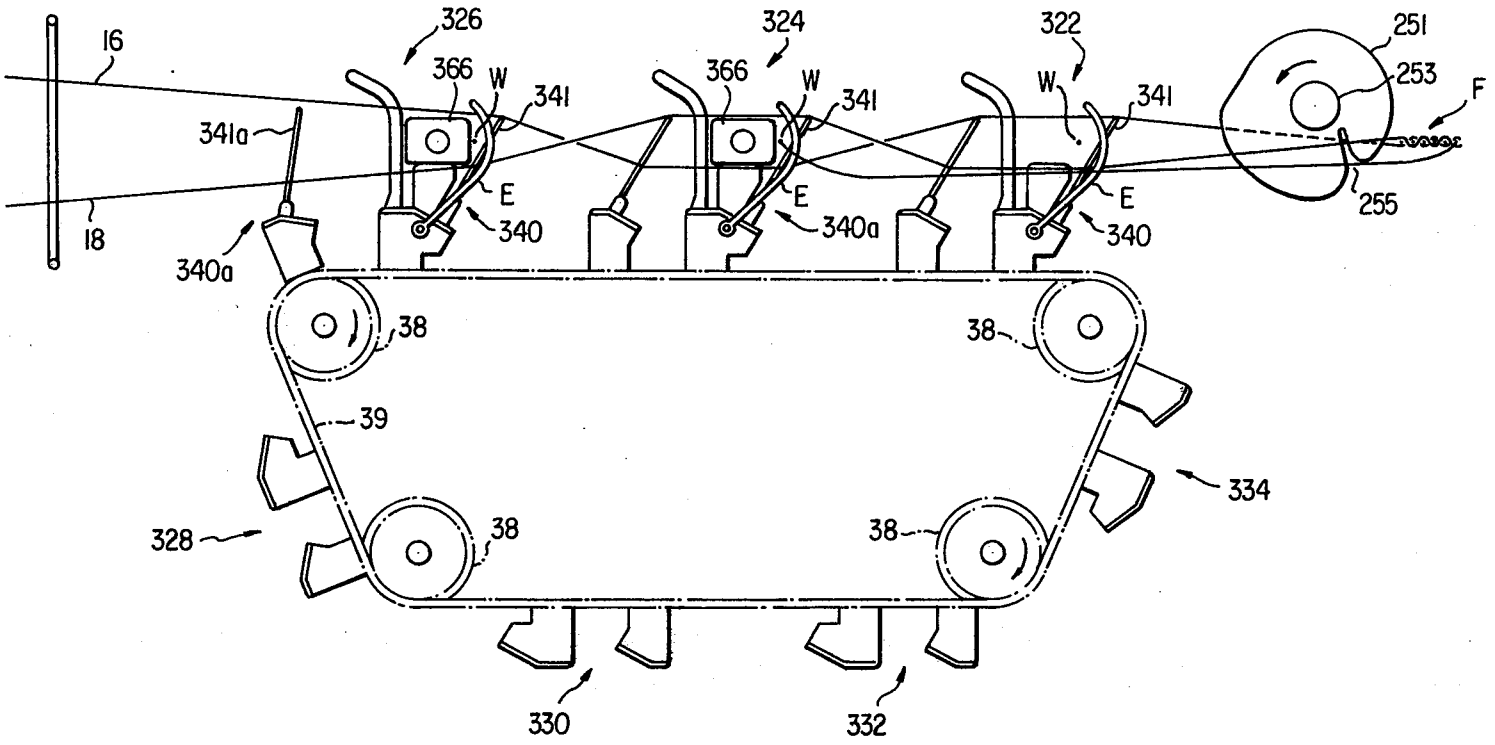

Turning now to FIG. 27*c*, it is seen that at station 326 the follow-up shed retainer 340*a* has had its plates 341*a* turned and they are in shed-retaining position, but they have not yet contacted the warp threads 16 and 18.

Figure 28C:
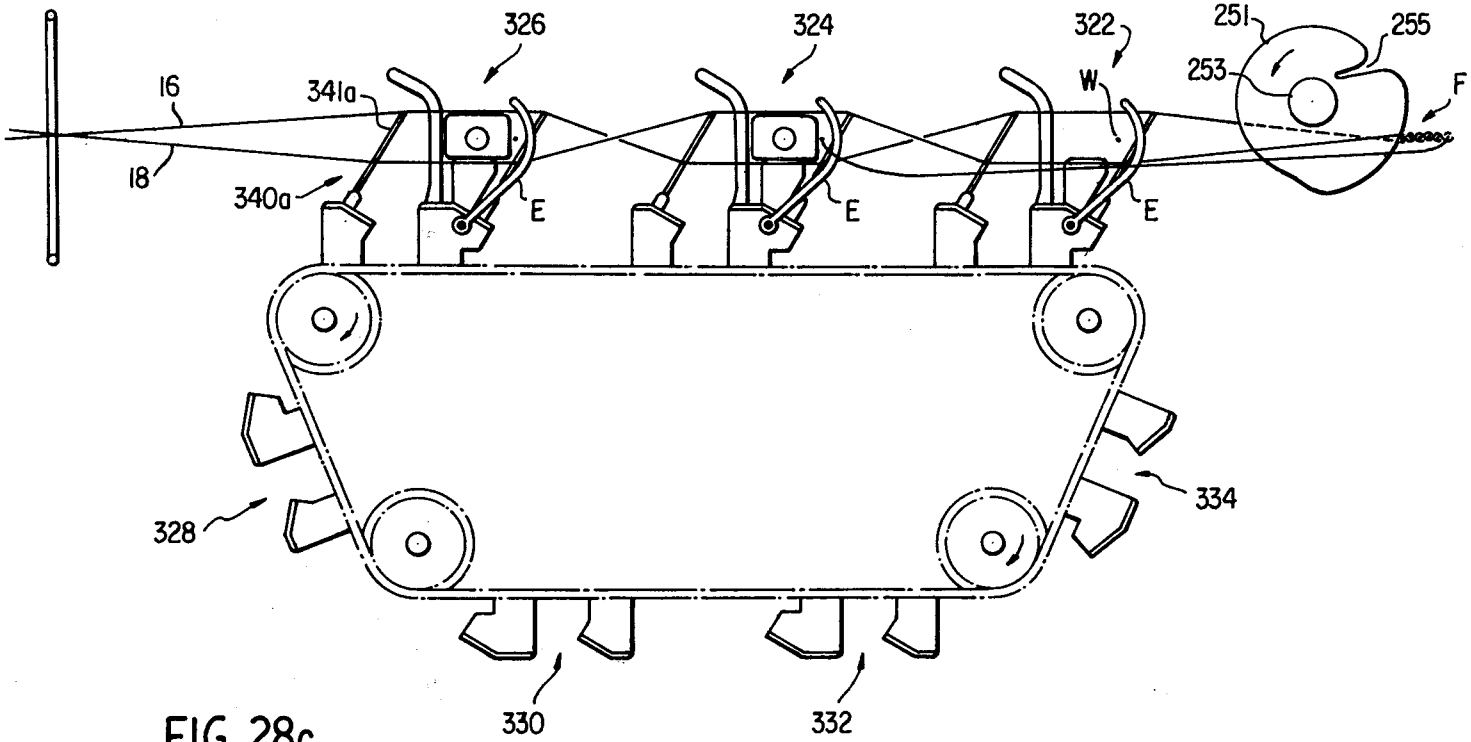
Figure 28D:
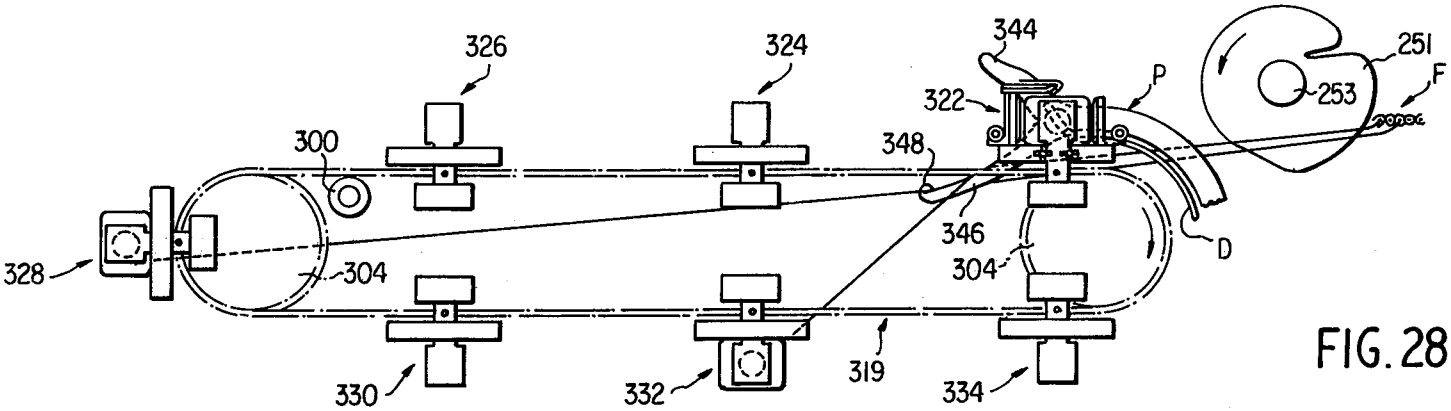

In FIG. 28*c*, the plates 341*a* of shed retainer 340*a* have now contacted the warp threads. In both stations 324 and 322 both of the retainers for each station are in shed-retaining position.

Figure 29D:
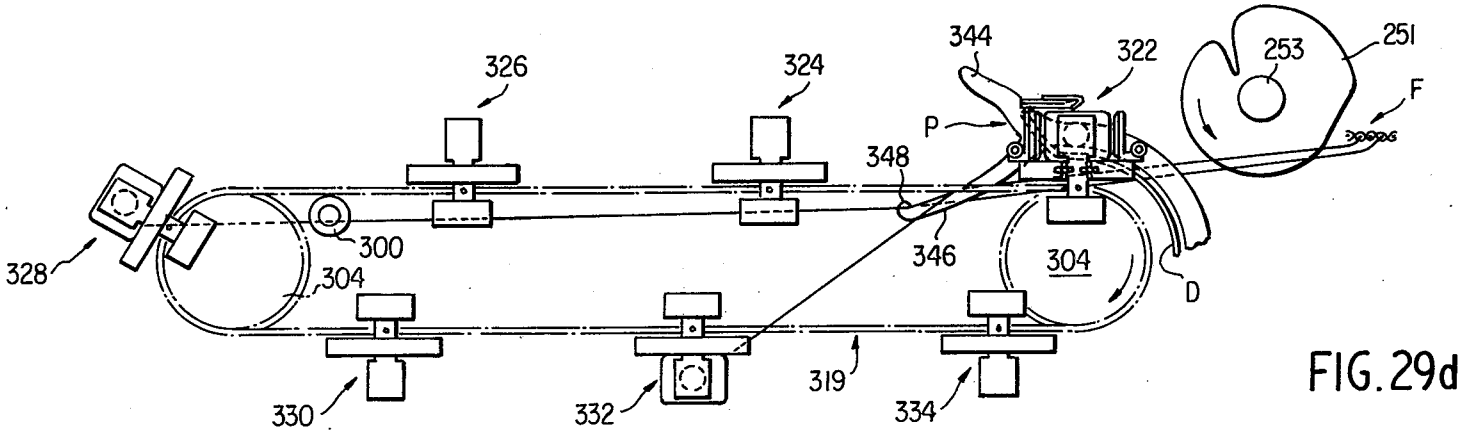
Figure 29A:
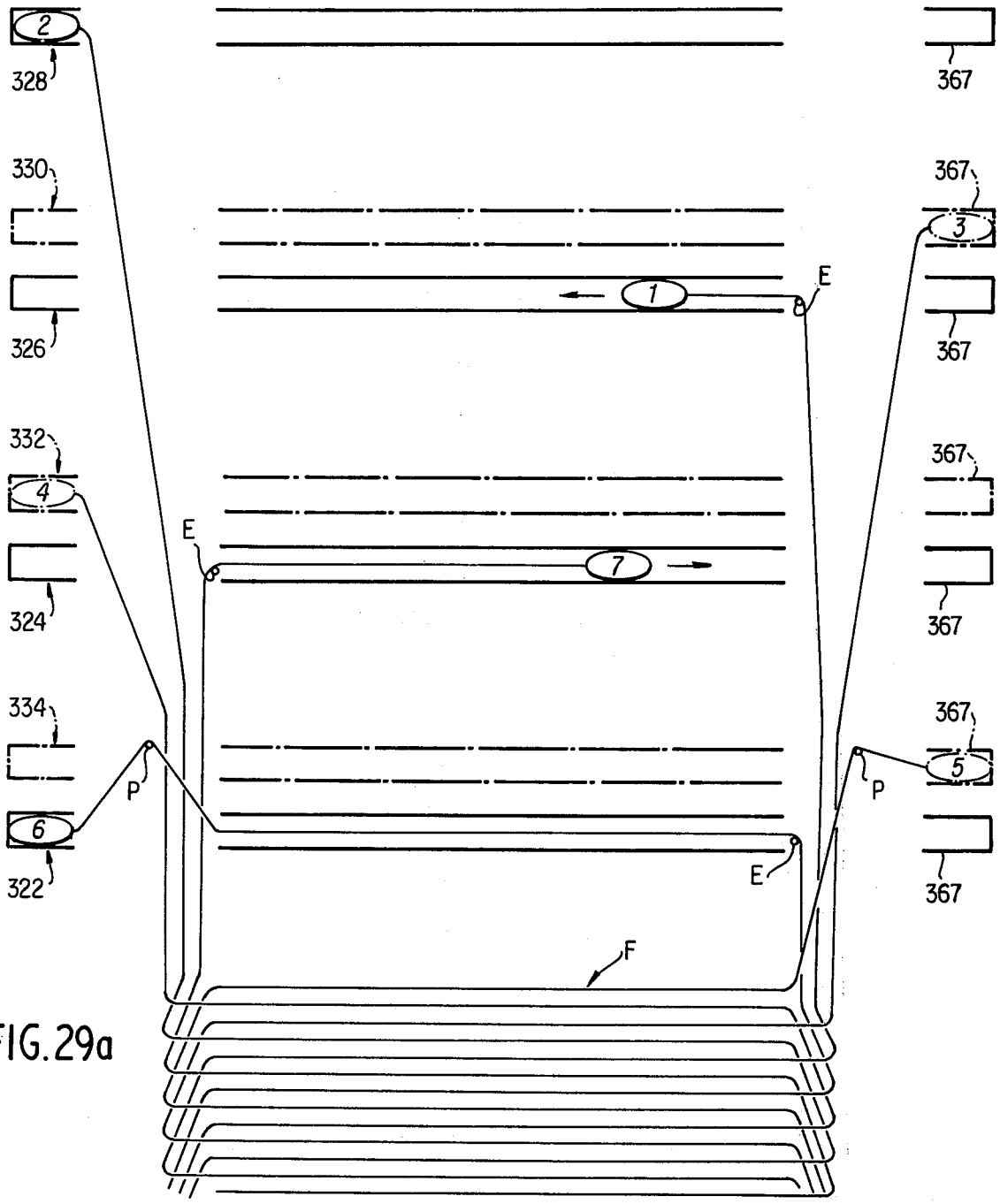
Figure 29B:
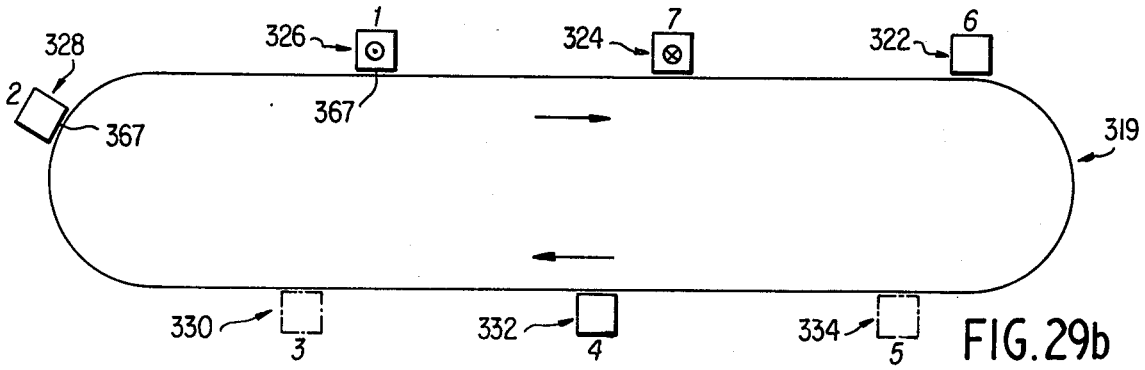
Figure 29C:
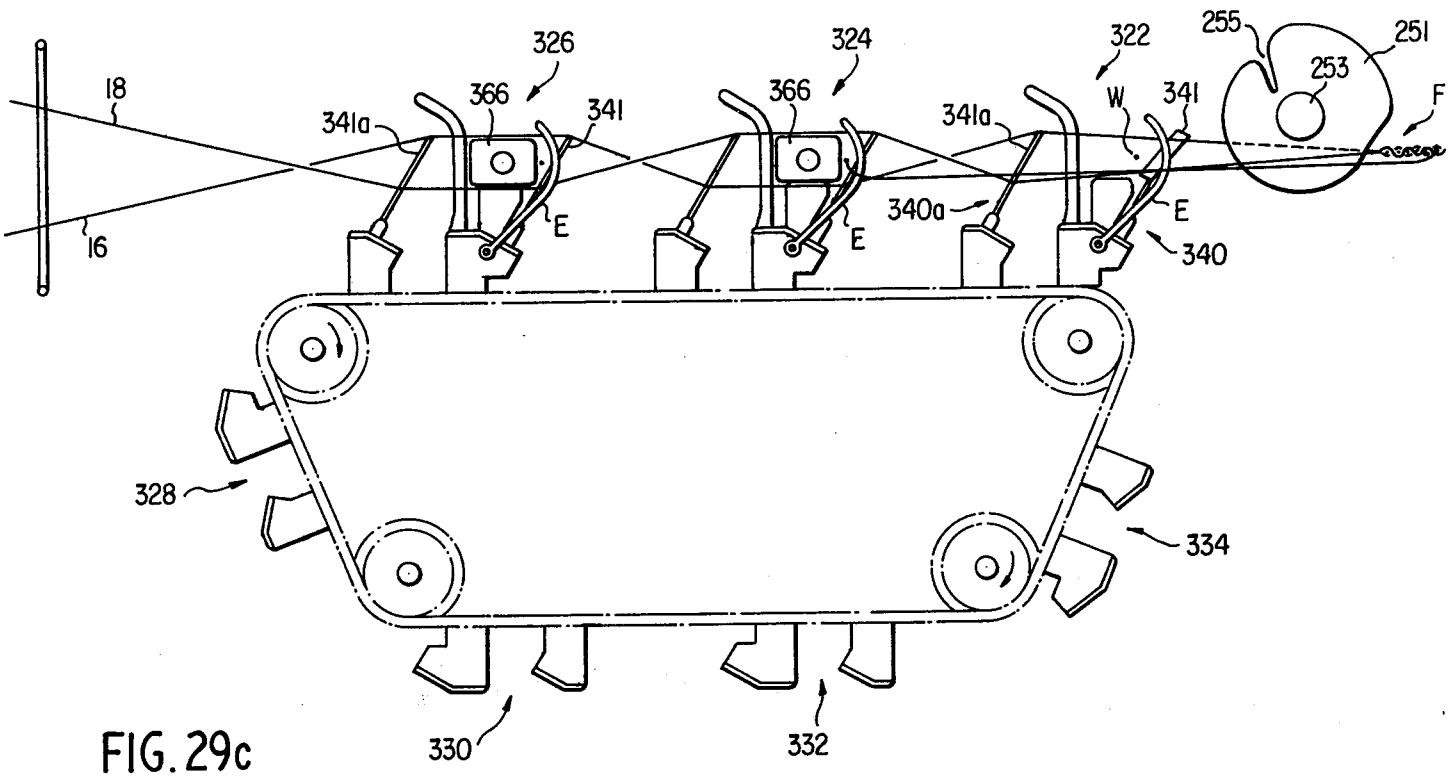

By the time the station 322 reaches the position shown in FIG. 29*c*, the leading shed retainer 240 has had its plates 341 rotated in order to release the shed. It will be observed that in FIGS. 26C, 27C, 28C and 29C no shuttle is shown in the position for station 322 indicating that the shuttle has already entered its shuttle box. This position for shuttle #6 is confirmed by reference to FIGS. 26*a*, 27*a*, 28*a* and 29*a*. In FIG. 30*c* the plates 341*a* of shed retainer 340*a* still maintain the shed open.

Figure 31C:
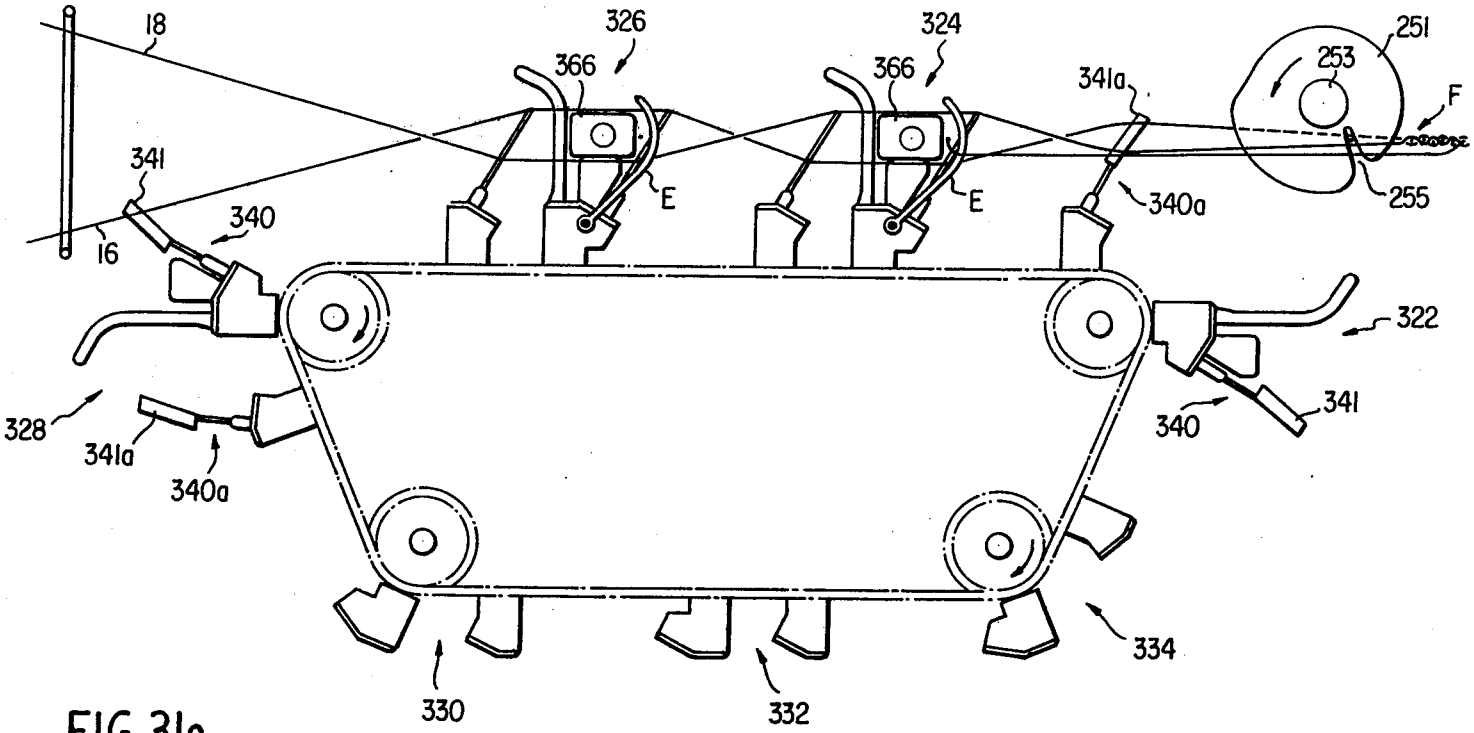

In FIG. 31*c* the plates 341*a* of shed retainer 340*a* has just been released at station 322 and shed retainer 341 of station 328 is just entering the shed between warp threads 16 and 18.

FIGS. 26*d* through 31*d* may be referred to for a fuller understanding of the functions of the tensioning guide P and the weft thread depressing guide D. These relatively schematic elevational views illustrate the handling of the weft threads as viewed from the left side of the loom with respect to the position shown in FIG. 26*a*. It should be observed that as the stations pass the shuttle-receiving position and move to the lower flight of the shuttle box conveyor 319 around sprockets 304, the length of weft thread increases as the shuttle boxes move away from the fell of the cloth F. The removal of the weft thread from the crevice in guide P is accomplished by the movement of the shuttle away from guide P as the shuttle travels on the lower flight of conveyor 319. The shape of lower arm 346 and the bottom of the notch or crevice is so curved to allow the weft thread to travel downward on arm 346 as the shuttle retreats. The shuttle holds or maintains tension on the weft thread as it does so. The combination of the tension and the rearward movement as seen at station 332 in FIGS. 26*d* to 31*d* lowers the weft thread as shown. It can also be seen that as the shuttle boxes reach their maximum point away from the fell of the cloth and begin to move from the lower flight of the conveyor to the upper flight that the weft thread begins to slacken. For example, the slack in the weft thread for shuttle #2 at station 328 increases as it moves from the position shown in FIG. 30*d* to the position shown in FIG. 31*d*. The shuttle 366 in the FIG. 31d position is about to be fired across the loom at which point the weft thread will simply lift out of the hook 348 with the weft thread being guided by weft thread and guide E. For example, this control of the trailing weft thread is illustrated schematically in FIG. 26*a* for shuttles 1 and 7.

The beat-up effected by the rotatable reed 251 rotaining on shaft 253 and the relative position of the weft thread receiving slot 255 are also shown in FIGS. 26*c*–31*c* and FIGS. 26*d*–31*d*. It should be noted that since shaft 253 rotates independently of the conveyor on which the shed-retaining means are located that it is possible to effect more than one beat-up of the roller 251 for each thread. For example, the shaft 253 can be rotated at twice the linear speed of the shed-retaining conveyor and thereby effect two beat-ups of the weft thread before the warp threads are released. It is also possible to vary the time of the beat-up with either the open shed or the closed shed. For example, in the FIG. 28*c* position the rotatable reed 251 is effecting an extra beat-up on the previously beaten-up weft thread. It is also possible to effect adjustment of the position longitudinally along the chain to vary the spacing between the rear retainer 340*a* on consoles 379*a* with respect to both the consoles 379 and the forward or leading retainer 340.

In the practice of the present invention, more than simply a plain weave may be woven. Thus it is not necessary that each warp thread's position be reversed on each operation of the harness mechanism. For a true representation of the position of the warp threads therefore some warp threads which are not changed would remain in their upper or lower position in the sheds and would extend horizontally or flat across the tops or bottoms of the shed retainers for as many sheds or picks as called for in the weaving pattern.

Although a rotary beat-up member 251 is disclosed, other forms of beat-up members, including reciprocating elements, may be employed.

Although the apparatus of this invention has been illustrated as operating in a horizontal plane, the apparatus may be operated vertically or at various angles to the horizontal. Although not shown, a suitable support means may be positioned, when desired, under the woven fabric at or near the fell for the purpose of supporting the fabric during the beat-up and/or for the purpose of limiting the forward motion of the beat-up member during the beat-up.

From the foregoing, it will be seen that in all embodiments disclosed herein the sheds may be formed conventionally, and through the novel features of this invention it becomes possible to form multiple sheds for the insertion of multiple shuttles or other weft-inserting-means concurrently. The sheds are continuously formed, continuously moved and continuously retained in a substantially straight line or plane path from the shed-forming means to a point adjacent the fell of the cloth being formed. Both the means for releasably holding the sheds independently of the position of the shed along its travel and when desired, guide means for the weft-inserting-means enter the formed shed and travel with it toward the fell of the cloth.

It should be noted that, although the weft-inserting apparatus whown uses conventional shuttles, this invention can be utilized with gripper shuttles, rapiers, needles, or other weft-laying means from either stationary weft supplies or weft supplies which move with the sheds.

While several embodiments of the invention have been illustrated and described, it will be recognized that the invention may be otherwise variously embodied and practiced within the scope of the claims which follow.

What is claimed is:

1. A method of weaving which comprises the steps of (a) forming a shed of warp members at a first location on a loom, (b) inserting means into said shed to traverse said warp members and retain said sheds, (c) moving said shed-retaining means and its associated shed forwardly along said warp members in a substantially straight plane toward the fell of the woven product while concurrently and successively forming successive sheds at said first location, (d) concurrently with said forward movement of said retaining means and shed, inserting retaining means successively into successive sheds at said first location to continuously retain one or more sheds having open weft-wise passageways traveling toward the fell of the woven product, (e) inserting a weft member successively by weft-laying means into each of said sheds formed successively at said first location, (f) removing said shed-retaining means from its shed-retaining position, (g) and beating up said weft members into the fell of the woven product.

2. A method of weaving as defined in claim 1, wherein the step of removing said shed-retaining means is performed successively at a location on said loom adjacent the fell of the woven product.

3. A method of weaving as defined in claim 1, wherein the step of beating up said weft members into said fell is performed by said shed-retaining means.

4. A method of weaving as defined in claim 1, wherein said step of removing said shed-retaining means is effected by moving said shed-retaining means angularly from a position transverse to said warp members to a position substantially parallel to said warp members.

5. A method of weaving as defined in claim 1, wherein the step of beating up said weft members is performed by separate beat-up means traveling with said shed-retaining means.

6. A method of weaving as defined in claim 1, wherein the step of beating up said weft member is performed by beat-up means independent of said shed-retaining means.

7. A method of weaving as defined in claim 1, wherein said forwardly moving shed-retaining means precede the weft-laying means and the weft member in each shed.

8. A method of weaving as defined in claim 1, wherein said forwardly moving shed-retaining means follow the weft-laying means and the weft member in each shed.

9. A method of weaving as defined in claim 1, wherein said forwardly moving shed-retaining means simultaneously precede and follow the weft-laying means and the weft member in each shed.

10. A method of weaving as defined in claim 1, including the additional step of compensating for warp member tension variations.

11. A method of weaving which includes the steps of (a) forming sheds of warp members successively at a first location on a loom by separating the warp members into different planes, (b) inserting shed-retaining means and weft-laying guide means into each of said sheds, after it has been formed, (c) moving said shed-retaining means and said weft-laying guide means and their associated shed in a substantially straight line path toward the fell of the woven product while concurrently forming additional sheds at said first location, (d) continuing to insert additional shed-retaining means and weft-laying guide means in said additional sheds after they have been formed to retain one or more continously open sheds traveling toward the fell of the woven product, (e) effecting the insertion of a weft member through said weft-laying guide means within each of said open sheds, (f) releasing said sheds, and (g) beating up said weft members into the fell of the woven product.

12. A method of weaving as defined in claim 11, including the additional step of releasing said sheds sequentially at a desired location on said loom adjacent the fell of the woven product.

13. A method of weaving as defined in claim 11, wherein said step of beating up said weft members is effected by said shed-retaining means.

14. A method of weaving as defined in claim 11, wherein said step of releasing said sheds is effected by rotating said shed-retaining means through a portion of a circle.

15. A method of weaving as defined in claim 11, including the additional step of inserting beat-up means along with said shed-retaining means and said shuttle guide means in each of said open sheds.

16. In a method of weaving wherein sheds are formed from warp members by shed-forming means operative to successively separate the warp members into different planes and weft members are inserted into said sheds by weft-inserting means and beat-up into the fell of the woven product, the improvement which comprises:

(a) continuously retaining, by means independent of said shed-forming means, one or more open sheds, each having a completely open weft-wise passageway for the continuous insertion of at least one weft member into each of said open sheds.

17. A method of weaving as defined in claim 16, wherein said beat-up is effected simultaneously all across the fell of the woven product.

18. A method of weaving as defined in claim 16, including the additional step of retaining said sheds open by a plurality of shed-retaining members while said shed-forming means concurrently and successively form additional sheds.

19. A method of weaving as defined in claim 18, wherein said beat-up is effected by beat-up means independent of all of said shed-forming means, said weft-inserting means and said shed-retaining means.

20. A method of weaving as defined in claim 18, wherein said shed-retaining members are mounted in a closed loop path.

21. A method of weaving as defined in claim 18, wherein said beat-up is effected by said shed-retaining members.

22. A method of weaving as defined in claim 18, including the additional step of retaining each of said sheds by one or more independently operated groups of shed-retaining members.

23. A method of weaving as defined in claim 18, including the step of releasing said sheds adjacent the fell of the woven product by changing the position of said shed-retaining members.

24. A method of weaving as defined in claim 23, wherein the change of position of said shed-retaining members to effect a release of the sheds includes rotating said shed-retaining members through an arc.

25. A method of weaving as defined in claim 23, including the additional step of compensating for warp-member tension variations.

26. A method of weaving as defined in claim 18, including the step of inserting guide means for said weft-insertion means into each of said sheds after they have been formed.

27. A method of weaving as defined in claim 26, including the additional steps of inserting beat-up means into said sheds after they have been formed, along with said shed-retaining members and said guide means and moving all of said means in unison toward the fell of the woven product.

28. A method of weaving as defined in claim 27, including the additional step of beating-up a weft member into the fell of the woven product by its associated inserted beat-up means simultaneously all across the fell of the woven product.

29. A method of weaving as defined in claim 26, including the additional step of mounting said shed-retaining members, guide means and beat-up means in a closed loop path.

30. A method of weaving as defined in claim 29, including the additional step of spring mounting said beat-up means to permit them to yield at a predetermined pressure at the fell of the woven product.

31. A method of weaving as defined in claim 26, including the step of moving said shed-retaining members and said guide means in a substantially straight line path toward the fell of the woven product.

32. An apparatus for weaving cloth comprising:

(a) shed-forming means for forming sheds from warp threads by separating the warp threads into different planes.

(b) shed-retaining means separate from said shed-forming means and engageable with said warp threads to retain said sheds, (c) means for advancing said shed-retaining means and thereby their associated sheds toward the fell of the cloth, (d) means for inserting a weft thread into each of said sheds during their movement toward the fell of the cloth, (e) means for releasing said sheds, and (f) beat-up means for beating up said weft threads into the fell of the cloth.

33. An apparatus for weaving cloth as defined in claim 32, wherein said means for advancing said shed-retaining means includes for moving said shed-retaining means is in a substantially straight line path.

34. An apparatus for weaving cloth as defined in claim 33, wherein said means for advancing said shed-retaining means constitutes a conveyor means and said advancement occurs along a substantially straight flight portion thereof.

35. An apparatus for weaving cloth as defined in claim 32, wherein said means for releasing said sheds includes stationary cam means for changing the position of said shed-retaining means.

36. An apparatus for weaving cloth as defined in claim 32, wherein said means for releasing said sheds includes means for imparting a rotary motion to said shed retaining means.

37. An apparatus for weaving cloth as defined in claim 32, wherein said shed-retaining means comprise elements having upper and lower surfaces selectively engageable with said warp threads.

38. An apparatus for weaving cloth as defined in claim 32, wherein said beat-up means is mounted for movement in predetermined spaced relationship with respect to said shed-retaining means and is inserted into said shed along with said shed-retaining means.

39. An apparatus for weaving cloth as defined in claim 32, wherein said shed-retaining means includes a plurality of shed-retaining assemblies, and wherein said means for advancing said shed-retaining assemblies follows a closed loop path.

40. An apparatus for weaving cloth as defined in claim 32, wherein said shed-retaining means and said means for releasing said sheds are both formed from the same retainer member.

41. A shed-retaining member for use in connection with the loom weaving of warp and weft threads into cloth of the type wherein said loom has a shed-forming means for elevating some of said warp threads and depressing others of said warp threads in accordance with a predetermined pattern, which comprises (a) a retainer member readily insertable between adjacent warp threads into one of said sheds defined by said elevated warp threads and said depressed warp threads, (1) said retainer member having an upper surface which in one rotational position is engageable with an elevated warp thread and said retainer member having a lower surface engageable with a depressed warp thread in the same rotational position, (2) said retainer member being rotatable to a second position where neither the elevated warp thread nor the depressed warp thread is retained on the respective upper and lower surfaces of said retainer member.

42. A shed-retaining member as defined in claim 41, wherein upper and lower surfaces of said retainer member are part of a closed loop.

43. A shed-retaining member as defined in claim 42, wherein said retainer member has a leading edge which serves as a beat-up surface for beating-up weft threads into the fell of said cloth.

44. A shed-retaining member as defined in claim 41, wherein the upper portion of said retainer member constitutes a thin plate member.

45. In a loom for weaving warp and weft threads into cloth of the type wherein sheds are formed from warp threads by shed-forming means operative to successively separate the warp threads into different planes and weft threads are inserted into said sheds by weft-laying means and beat up into the fell of the cloth, the improvment comprising:

(a) conveyor means for transporting a plurality of series of shed-retaining members arranged to travel during at least a portion of said travel in a direction substantially parallel to said warp threads, and (b) said conveyor means extending substantially in a straight line from said shed-forming means to a location adjacent the fell of the cloth and having a length of travel sufficiently long to permit the retention of one or more sheds and the operation of one or more weft thread-inserting members.

46. In a loom for weaving warp and weft threads as defined in claim 45, wherein said conveyor means also transports beat-up members which are insertable into each shed after it has been formed by said shed-forming means.

47. In a loom for weaving warp and weft threads as defined in claim 46, wherein said conveyor means has a plurality of laterally spaced beat-up members each are insertable into the same shed whereby said weft threads are beaten up into the fell of the cloth simultaneously all across the cloth.

48. In a loom for weaving warp and weft threads as defined in claim 47, wherein said beat-up members are spring mounted.

49. In a loom for weaving warp and weft threads as defined in claim 45, wherein said conveyor means further transports shuttle guide members which are spaced a predetermined distance from said shed-retaining members.

50. In a loom for weaving warp and weft threads as defined in claim 45, wherein said shed-retaining members are rotatably mounted on said conveyor means.

51. In a loom for weaving warp and weft threads as defined in claim 45, wherein said beat-up members are fixedly mounted and independent of said shed-retaining means.

52. In a loom for weaving warp and weft threads as defined in claim 45, including means for providing substantially constant warp thread tension during the operation of said shed-retaining members.

53. In a loom for weaving textile fabrics:

(a) means for continuously forming a series of successive sheds in warp members by separating the warp members into different planes, said series extending in a flat plane between the fell of the fabric and said shed-forming means.

(b) means independent of said shed-forming means for retaining an opening transversely of said warp members completely through each shed of the series and for simultaneously causing said open sheds to travel toward the fell of the fabric, (c) means for inserting a weft member into each open shed of the series of successive sheds, (d) said weft-member-inserting-means operating to insert a succeeding weft member into a succeeding shed before the preceding weft member in the preceding shed has completed its travel through its opening, whereby at any given instant one or more weft members are traveling weft-wise in their respective sheds at different progressive stages of their travel.

54. Apparatus according to claim 53 wherein the means for retaining an opening through said sheds comprises;

(a) retainer means having first and second operative positions, said retainer means in said first operative position providing bearing surfaces against which the warp members bear for retaining the warp members at spaced separation, said retainer means in said second operative position having its bearing surfaces parallel with and between said warp members, (b) and means for changing said retainer means from said first to said second operative position when said shed arrives adjacent the fell of the fabric.

55. Apparatus according to claim 54, wherein said means for changing said retainer means from said first to said second operative position includes means for rotating said retainer means through a portion of a circle.

56. Apparatus according to claim 55 wherein:

(a)beat-up means are provided for beating up each weft member into the fell of the cloth.

57. Apparatus according to claim 56, wherein:

(a) said beat-up means are part of said retainer means and travel therewith.

58. Apparatus according to claim 56, wherein:

(a) non-traveling beat-up means are provided at the fell of the fabric.

59. Apparatus according to claim 53 wherein:

(a) beat-up means are provided for beating up each weft member into the fell of the fabric.

60. Apparatus according to claim 59 wherein said beat-up means move with the series of successive sheds as said sheds travel toward the fell of the fabric.

61. Apparatus according to claim 60, wherein said beat-up means are an integral part of said means retaining said opening through said shed.

62. Apparatus according to claim 59 wherein non-traveling beat-up means are provided at the fell of the fabric.

63. Apparatus according to claim 62, wherein said non-traveling beat-up means serve to space said warp members laterally.

64. Apparatus according to claim 59, wherein:

(a) guide members are provided in said sheds for said weft-member-inserting means.

65. Apparatus according to claim 64, wherein:

(a) said guide members are integral with shed retainer means.

66. Apparatus according to claim 53 wherein:

(a) guide members are provided in said sheds for said weft-member-inserting means.

67. Apparatus for weaving a textile product comprising:

(a) means for forming a shed of warp members by separating the warp members into different planes, (b) means independent of said shed-forming means for retaining an open passageway completely through said shed for the passage of weft-inserting means for a weft member, (c) means for moving said shed and said retaining means along a flat plane in the longitudinal direction of the warp members, (d)means for inserting a weft member through said open passageway during said movement of said shed and retaining means, (e) means for moving said retaining means out of retention position, thereby to release said shed, and (f) means for beating up the weft member into the fell of the textile product.

68. Apparatus according to claim 67, including means for providing substantially constant warp thread tension.

69. Apparatus according to claim 67, wherein the means for beating up the weft members are part of the shed-passageway-retaining means.

70. Apparatus according to claim 67, wherein said shed-forming means, said shed-passageway-retaining means, said weft-member-inserting means, and said beat-up means are adapted for operation on a continuous series of successive sheds.

71. A weft thread-inserting apparatus for a loom wherein sheds are successively formed from warp members by shed-forming means, which comprises:

(a) a shed-retaining conveyor having means thereon for retaining a series of said successive sheds and for causing said sheds to travel along said warp members toward the fell of a fabric, (b) a first shuttle box conveyor driven in synchronism with said shed-retaining conveyor mounted on one side of said shed-retaining conveyor and a second shuttle box conveyor driven in synchronism with said shed-retaining conveyor mounted on the opposite side of said shed-retaining conveyor, and (c) means for firing shuttles from said first and second shuttle box conveyors for the insertion of weft threads into said traveling sheds.

72. A weft thread-inserting apparatus as claimed in claim 71, wherein said means for firing shuttles fires said shuttles alternately from shuttle boxes on said first shuttle box conveyor to said second shuttle box conveyor and from said second shuttle box conveyor to said first shuttle box conveyor.

73. A weft thread-inserting apparatus as claimed in claim 71, wherein each of said shuttle box conveyors includes picking means movable laterally on said shuttle box conveyors and includes track means for guiding said picking means.

74. A weft thread-inserting apparatus as claimed in claim 71, including thrust-absorbing means to stop the movement of said picking means toward said shed-retaining conveyor.

75. A weft thread-inserting apparatus as defined in claim 74 wherein said picking means includes both stationary members and movable members and said apparatus includes means to reposition said movable members.

76. In a weft thread handling system wherein sheds are successively formed from warp members by shed-forming means, the combination which comprises:

(a) a shed-retaining conveyor having means thereon for retaining a series of said successive sheds and for causing said sheds to travel along said warp members toward the fell of a fabric, (b) a first shuttle box conveyor driven in synchronism with said shed-retaining conveyor mounted on one side of said shed-retaining conveyor and a second shuttle box conveyor driven in synchronism with said shed-retaining conveyor mounted on the opposite side of said shed-retaining conveyor, (c) means for firing shuttles for the insertion of weft threads into said traveling sheds alternately from shuttle boxes on said first shuttle box conveyor to said second shuttle box conveyor and from said second shuttle box conveyor to said first shuttle box conveyor, and (d) means for maintaining control of and tension of said weft thread from the time said shuttles are fired until the time of beat-up of said weft threads into the fell of the cloth.

77. In a weft thread handling system as claimed in claim 76, wherein said means for maintaining tension on said weft thread includes a first stationary guide member having upper and lower legs and a crevice therebetween for guiding said weft thread.

78. In a weft thread handling system as claimed in claim 77, wherein said tensioning means further includes a guide member mounted with a shed-retaining member on the shed-retaining conveyor and which is movable therewith.

79. In a weaving loom utilizing a plurality of moving warp sheds formed by shed-forming means for separating warp threads into different planes, wherein the sheds move in the direction of the warp threads, and wherein the sheds have an open weft-wise passageway, the method of supplying and laying weft threads in each of said moving sheds, comprising the steps of:

continuously retaining, by means independent of said shed-forming means, one or more open sheds for the continuous insertion of at least one weft thread into each of said open sheds, and moving weft-laying means with weft thread through one of said moving and open warp sheds, said weft-laying means being unconnected to said loom during its traversal through said one of said moving warp sheds, whereby weft thread is laid in said one of said moving warp sheds during the entire time said weft-laying means traverses said moving warp shed.

80. In a weaving loom utilizing a plurality of moving warp sheds formed by shed-forming means for separating warp threads into different planes, wherein the sheds move in the direction of the warp threads, and wherein the sheds have an open weft-wise passageway, the method of supplying and laying weft threads in each of said moving sheds, comprising the steps of:

continuously retaining, by means independent of said shed-forming means, one or more open sheds for the continuous insertion of at least one weft thread into each of said open sheds, and firing a shuttle with weft thread through one of said moving and open warp sheds, said shuttle being unconnected to said loom during its traversal through said one of said moving warp sheds, whereby weft thread is laid in said one of said moving warp sheds during the entire time said shuttle traverses said moving warp shed.

81. A weft-thread inserting apparatus for a loom wherein sheds are successively formed from warp members by shed-forming means, which comprises:

(a) a shed-retaining conveyor having means thereon for retaining a series of said successive sheds and for causing said shed-retaining means and said sheds to travel in a direction substantially parallel to said warp members toward the fell of a fabric, (b) a shuttle box conveyor driven in synchronism with said shed-retaining conveyor, and (c) means for firing shuttles from said shuttle box conveyor for the insertion of weft threads into said traveling sheds.

82. An apparatus for weaving cloth comprising:

(a) shed-forming means for continuously forming warp threads into a series of successive sheds having open weft-wise passageways by separating the warp threads into different planes, (b) shed-retaining means separate from said shed-forming means and engageable with said warp threads for continuously retaining one or more of said sheds while simultaneously successive sheds are being formed by said shed-forming means and being retained by said shed-retaining means, (c) means for advancing said shed-retaining means and thereby their associated sheds in a substantially straight plane toward the fell of the cloth so that one or more sheds are continuously traveling toward the fell of the cloth, (d) means for inserting and laying a weft thread in each of said open sheds during their movement toward the fell of the cloth, (e) means for releasing said sheds, and (f) beat-up means for beating up said weft threads into the fell of the cloth.

* * * * *

UNITED STATES PATENT AND TRADEMARK OFFICE

CERTIFICATE OF CORRECTION

PATENT NO. : 4,122,871

DATED : October 31, 1978

INVENTOR(S) : Thomas F. McGinley

It is certified that error appears in the above-identified patent and that said Letters Patent are hereby corrected as shown below:

Column 1, line 16, the word "determinded" should read -- determined --.

Column 18, line 3, after the word "includes" insert -- means --.

Column 18, line 4, delete the word "is".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*